US008273418B2

(12) United States Patent
Katagami et al.

(10) Patent No.: US 8,273,418 B2
(45) Date of Patent: Sep. 25, 2012

(54) HEAD UNIT ARRANGEMENT METHOD, LIQUID DROPLET EJECTION APPARATUS, METHOD OF MANUFACTURING ELECTRO-OPTIC DEVICE, AND ELECTRO-OPTIC DEVICE

(75) Inventors: Satoru Katagami, Hara (JP); Hirofumi Kobayashi, Shiojiri (JP); Sadaharu Komori, Shiojiri (JP)

(73) Assignee: Seiko Epson Corporation (JP)

( * ) Notice: Subject to any disclaimer, the term of this patent is extended or adjusted under 35 U.S.C. 154(b) by 856 days.

(21) Appl. No.: 12/332,425

(22) Filed: Dec. 11, 2008

(65) Prior Publication Data

US 2009/0160890 A1 Jun. 25, 2009

(30) Foreign Application Priority Data

Dec. 21, 2007 (JP) ..... 2007-330800

(51) Int. Cl.
*B05C 11/10* (2006.01)

(52) U.S. Cl. ..... 427/427.2; 347/40; 347/42; 347/43; 347/49; 347/108

(58) Field of Classification Search ..... 427/8, 9, 427/10, 427.2; 347/40, 42, 43, 49, 108; 156/64
See application file for complete search history.

(56) References Cited

U.S. PATENT DOCUMENTS 7,907,306 B2 * 3/2011 Yamazaki ..... 358/3.03
2011/0234673 A1 * 9/2011 Ueshima ..... 347/14

FOREIGN PATENT DOCUMENTS

JP 2005-349381 12/2005

* cited by examiner

*Primary Examiner* — George Koch
(74) *Attorney, Agent, or Firm* — Harness, Dickey & Pierce, P.L.C.

(57) ABSTRACT

Provided herein is a head unit arrangement method for arranging a plurality of head units in a liquid droplet ejection device that plots an image in a matrix form with functional liquid droplets in a number n of colors by performing the number n of primary scans and a number (n−1) of secondary scans. The head unit arrangement method includes evaluating liquid droplet ejection performance of each of the head units based on an inspection result of a volume of liquid droplet ejection from each of the functional liquid droplet ejection heads to arrange two of the head units that exhibit the lowest liquid droplet ejection performance at both ends in the Y-axis direction.

7 Claims, 28 Drawing Sheets

STRIPE

MOSAIC

DELTA

HEAD UNIT ARRANGEMENT METHOD, LIQUID DROPLET EJECTION APPARATUS, METHOD OF MANUFACTURING ELECTRO-OPTIC DEVICE, AND ELECTRO-OPTIC DEVICE

The entire disclosure of Japanese Patent Application No. 2007-330800, filed Dec. 21, 2007, is expressly incorporated by reference herein.

BACKGROUND

1. Technical Field

The present invention relates to a head unit arrangement method for arranging a plurality of head units in alignment with a Y-axis direction in a liquid droplet ejection apparatus for plotting an image in a matrix form with functional liquid in a number n of colors, and a liquid droplet ejection apparatus, a method of manufacturing an electro-optic apparatus, and an electro-optic apparatus.

2. Related Art

Not using this kind of head unit arrangement method, a liquid droplet ejection apparatus equipped with a plurality of functional liquid droplet ejection heads for respective colors that are arranged in the form of a staircase, a plurality of carriage units arranged in alignment with a Y-axis direction, a set table on which a workpiece is set, an X-axis table that moves the set table in an X-axis direction, and a Y-axis table that moves a plurality of head units in the Y-axis direction has been known, as described in JP-A-2005-349381. In such a liquid droplet ejection apparatus, the plurality of functional liquid droplet ejection heads for respective colors are provided so as to form a plurality of partial plotting lines (divisional plotting lines) in respective colors; a plotting process is done by repeating a primary scan in which the respective functional liquid droplet ejection heads are driven synchronously with movement in the X-axis direction, and a secondary scan in which they are moved in the Y-axis direction by the length of a partial plotting line.

For such a liquid droplet ejection apparatus to achieve efficient plotting and to plot on workpieces of a plurality of sizes, a plurality of head units having aligned thereon a plurality of functional liquid droplet ejection heads are arranged to extend in a width direction and to cover the entire area of a workpiece. Accordingly, those of the plurality of functional liquid droplet ejection heads that are positioned at both ends are used less frequently; and those two head units positioned at both ends are used less frequently than those head units positioned in the intermediate portion between the above two head units. In plotting results produced on a workpiece, a central part stands out against both sides, which tends to result in visible color variation in the central part. Accordingly, the head units which are positioned in the intermediate portion and are adapted to plot on a central part of a workpiece tend to cause occurrence of color variation.

In the above liquid droplet ejection apparatus, however, a difference in frequency of use or occurrence of color variation among respective head units is not taken into consideration, which has caused the liquid droplet ejection apparatus to involve a problem that appropriate arrangement of head units cannot be done. For example, those of a plurality of head units that exhibit high performance may be arranged at both ends on which they are used less frequently and the degree of occurrence of color variation is low, which causes a problem that accurate plotting cannot be achieved.

SUMMARY

An advantage of some aspects of the invention is to provide a head unit arrangement method and a liquid droplet ejection apparatus that allow for appropriate arrangement of a plurality of head units and accurate, efficient plotting processes, a method of manufacturing an electro-optic apparatus and an electro-optic apparatus.

A head unit arrangement method according to one aspect of the invention is achieved by using a plurality of head units each having a carriage on which functional liquid droplet ejection heads for each of a number n of colors for forming a plurality of divisional plotted lines in each of the colors in the Y-axis direction by the respective nozzle rows are arranged to be staggered in the Y-axis direction. The method is achieved by further using a liquid droplet ejection apparatus that has the head units in a condition that they are arranged in alignment with the Y-axis direction and ejects functional liquid in the number n of colors to plot an image in a matrix form by performing a number n of primary scans for plotting by moving the head units relative to a workpiece in an X-axis direction and a number (n−1) of secondary scans by moving the head units by a space equivalent to the divisional plotted line relative thereto in the Y-axis direction. The head unit arrangement method for arranging the plurality of head units in alignment with the Y-axis direction in the liquid droplet ejection apparatus includes: (a) inspecting ejection volumes of liquid droplets by each of functional liquid droplet ejection heads, (b) evaluating a liquid droplet ejection performance of each of the heat units on the basis of the above inspection results, and (c) arranging two head units exhibiting the lowest liquid droplet ejection performance to both the ends in the Y-axis direction, respectively.

With this configuration, it is possible to arrange two head units exhibiting the lowest liquid droplet ejection performance at both ends of an alignment of multiple head units, thereby allocating the head units exhibiting lower liquid droplet ejection performance to both the ends on which they are used less frequently and the degree of occurrence of color variation is low. This allows arranging head units properly and using efficiently head units exhibiting higher liquid droplet ejection performance. This also allows preventing color variation, resulting in accurate plotting.

In this situation, it is preferable that the mounted functional liquid droplet ejection heads be ranked depending on whether they satisfy the following conditions: (A) a condition of a variation range under which the variation that is in the liquid droplet ejection volume among respective ejection nozzles on a nozzle row and is obtained through inspection, is within a prescribed variation range; and (B) a condition of an intercept range under which differences between the average of the liquid droplet ejection volumes among the respective ejection nozzles in which the volumes are obtained through inspection and two liquid droplet ejection volumes of two ejection nozzles located at both ends of the nozzle row, are within a prescribed permissible range. It is also preferable that the head units be evaluated on the basis of the ranks given to the respective functional liquid droplet ejection heads in evaluation of the liquid droplet ejection performance of the head units.

With this configuration, the respective functional liquid droplet ejection heads are ranked using the above conditions of the variation range and intercept range, and then the head units are evaluated on the basis of the respective ranks, which allows evaluating the head units accurately and properly. The use of the ranks may facilitate comparison of the respective functional liquid droplet ejection heads.

In this situation, it is preferable that the lowest of the ranks given to the mounted functional liquid droplet ejection heads be used as an evaluation of each of the head units in evaluation of the liquid droplet ejection performance of the head unit.

With this configuration, the lowest of the ranks given to the respective functional liquid droplet ejection heads that is closely connected to occurrence of color variation is used as an evaluation of the liquid droplet ejection performance of the head unit, which allows evaluating the liquid droplet ejection performance of the head units properly and accurately. The head units are evaluated by the lowest rank, which allows comparing the respective head units easily.

In this situation, it is preferable that the evenness in the liquid droplet ejection volume between head units be evaluated on the basis of the difference in the liquid droplet ejection volume between nearest ejection nozzles for each color which are on different adjacent head units; it is also preferable that the respective head units except the two positioned at both ends be arranged so that a combination thereof may exhibit the greatest evenness in the liquid droplet ejection volume.

With this configuration, it is possible to evaluate the evenness in the liquid droplet ejection volume between head units based on the difference in the liquid droplet ejection volume between nearest ejection nozzles for each color which are on different adjacent head units, arrange the respective head units so that a combination thereof may exhibit the greatest evenness in the liquid droplet ejection volume, thereby diminishing a difference in the liquid droplet ejection volume between head units. This allows preventing color variation and streaking, resulting in more accurate plotting.

In this situation, it is preferable that the evenness in the liquid droplet ejection volume be evaluated on the basis of the maximum among the differences in the liquid droplet ejection volumes obtained for all colors at all boundaries between head units in evaluation of the evenness in the liquid droplet ejection volume between head units.

With this configuration, it is possible to evaluate accurately and properly the evenness in the liquid droplet ejection volume based on the maximum among the differences in the liquid droplet ejection volume obtained for all colors at all boundaries.

In this situation, it is preferable that the liquid droplet ejection volumes of two ejection nozzles used to calculate the difference in the liquid droplet ejection volume be average values among liquid droplet ejection volumes of two or more ejection nozzles located at respective adjacent ends.

With this configuration, it is possible to diminish the variation in the liquid droplet ejection volume, the variation occurring on one of the above two ejection nozzles. This allows calculating a combination satisfying the above conditions accurately.

In this situation, a plurality of head units are selected from numerous candidate head units that are candidates for mounting; it is preferable that a plurality of head units exhibiting the highest liquid droplet ejection performance be selected from the numerous candidate head units in selection of the plurality of head units.

With this configuration, more accurate plotting may be achieved by selecting for use head units exhibiting higher liquid droplet ejection performance from numerous candidate head units that are candidates for mounting.

The liquid droplet ejection apparatus according to another aspect of the invention includes a plurality of head units arranged by the above head unit arrangement method and an X-Y movement mechanism that moves a workpiece relatively to the head units in X- and Y-axis directions.

With this configuration, it is possible to improve the yield of a workpiece by using the head unit arrangement method which method allows for accurate plotting.

In this situation, the X-Y movement mechanism is configured so that each of the plurality of head units is independently movable.

With this configuration, each head unit is configured to be independently movable, which allows performing a plotting or maintenance operation by each individual head unit.

A method for manufacturing an electro-optic apparatus according to a further aspect of the invention features to provide a film formed portion on a workpiece by functional liquid droplets by using the above liquid droplet ejection apparatus.

An electro-optic apparatus according to a still further aspect of the invention features to have a film formed portion which is formed on a workpiece by functional liquid droplets by using the above liquid droplet ejection apparatus.

With this configuration, it is possible to manufacture electro-optic apparatuses with high quality efficiently. Functional materials include a light-emitting material for an organic electroluminescence (EL) apparatus (i.e., electroluminescent layer, positive hole injection layer), a filter material (filter element) for a color filter used in a liquid crystal display, a fluorescent material (phosphor) for a field emission display (FED), a fluorescent material (phosphor) for a plasma display panel (PDP) apparatus, and an electrophoretic material (electrophoretic substance) for an electrophoretic display, the materials being liquid materials ejectable by functional liquid droplet ejection heads (inkjet heads). Electro-optic apparatuses (flat panel displays or FPDs) include an organic EL apparatus, a liquid crystal display, a field emission display apparatus, a plasma display panel apparatus (PDP apparatus) and an electrophoretic display.

BRIEF DESCRIPTION OF THE DRAWINGS

The invention will be described with reference to the accompanying drawings, wherein like numbers reference like elements.

DESCRIPTION OF EXEMPLARY EMBODIMENTS

A liquid droplet ejection apparatus to which a head unit arrangement method according to an embodiment of the invention is applied will be described hereinafter with reference to the accompanying drawings. A liquid droplet ejection apparatus according to the embodiment is incorporated into a production line of a flat panel display; it uses its functional liquid droplet ejection head to which functional liquid, e.g., a special ink or luminous resin liquid is introduced to form luminous elements that constitute pixels included in a color filter of a liquid crystal display or in an organic EL apparatus.

Figure 1:
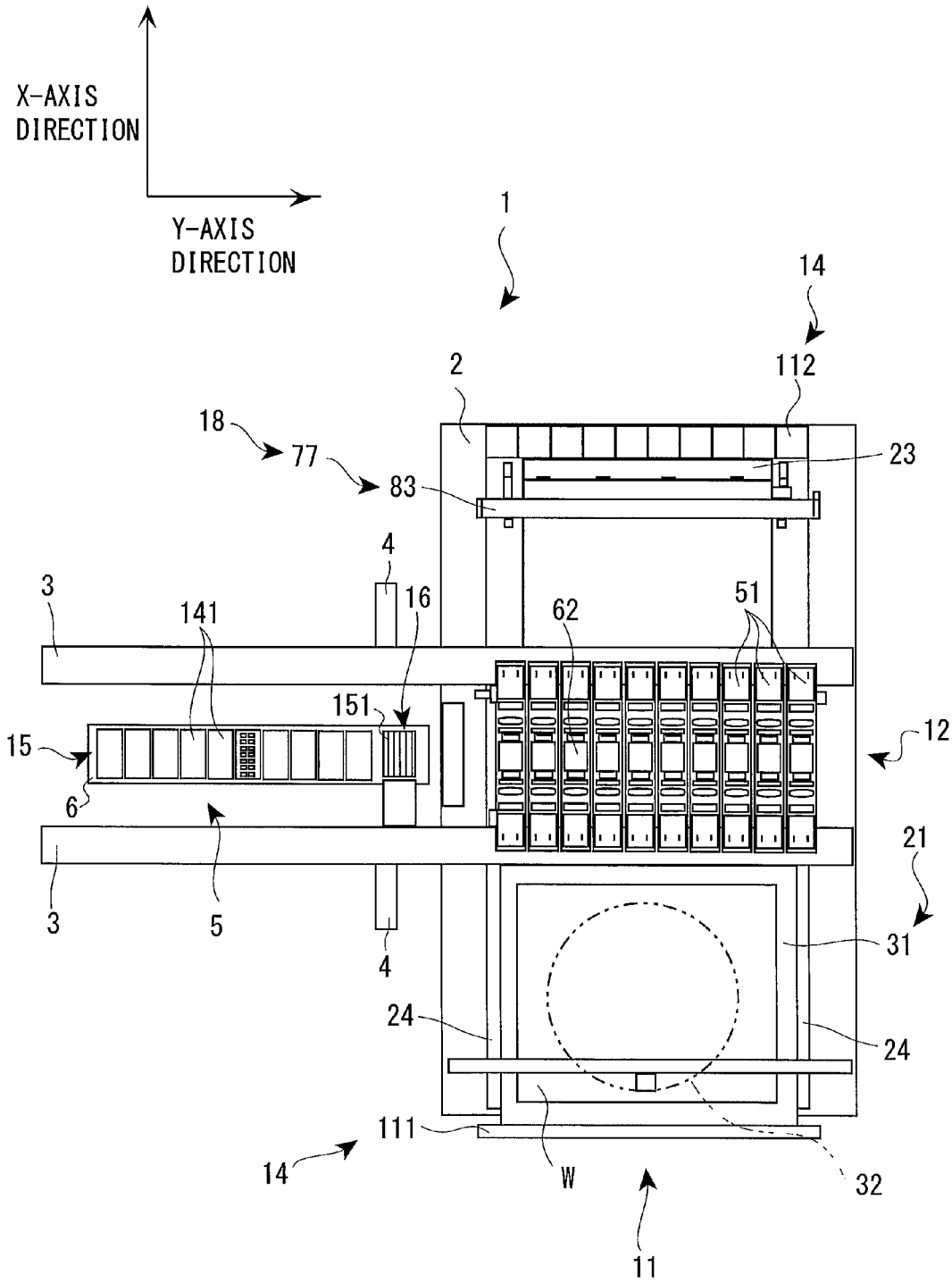
FIG. 1 is a plane view of a liquid droplet ejection apparatus according to embodiments of the invention.
Figure 2:
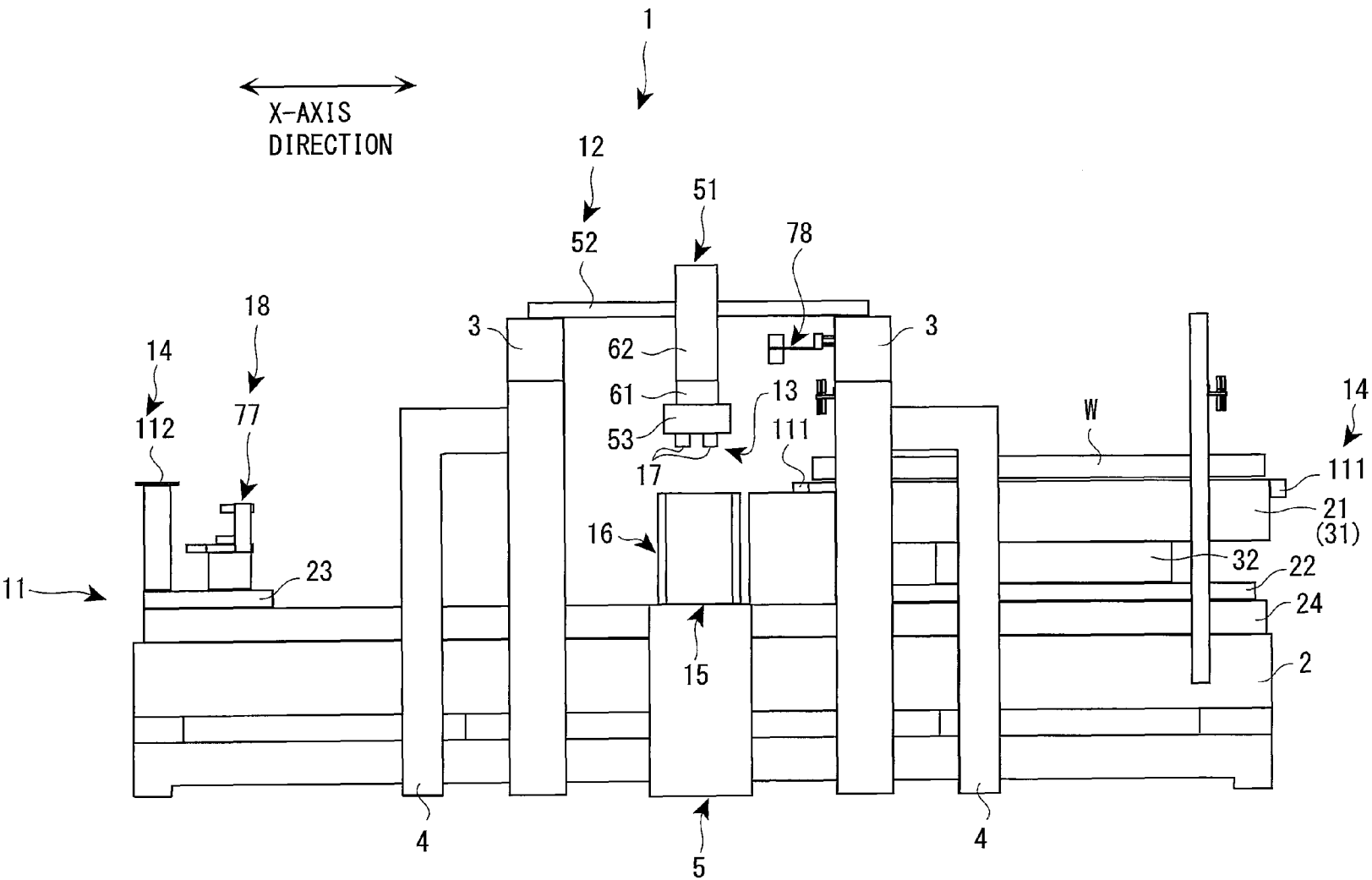
FIG. 2 is a side view of the liquid droplet ejection apparatus.

As shown in FIGS. 1 and 2, a liquid droplet ejection apparatus 1 includes an X-axis table 11 that is set up on an X-axis support base 2 supported by a stone surface plate to extend in an X-axis direction that is a primary scan direction, moving a workpiece W in the X-axis direction (primary scan direction), a Y-axis table 12 that is set up on a pair of (or two) Y-axis support bases 3 extending to cross over the X-axis table 11 with the assistance of a plurality of poles 4, extending in a Y-axis direction that is a secondary scan direction, and ten carriage units 51 each having mounted thereon a plurality of functional liquid droplet ejection heads 17, the ten carriage units 51 hung from the Y-axis table 12 in alignment with the Y-axis direction. Synchronized with movements of the X-axis table 11 and Y-axis table 12, the functional liquid droplet ejection heads 17 are driven for ejection; whereby functional liquid droplets in RGB, three colors are ejected, and then a prescribed plotting pattern is plotted on the workpiece W. The X-Y movement mechanism described in the appended claims is formed of the X-axis table 11 and Y-axis table 12.

The liquid droplet ejection apparatus 1 also includes a maintenance device 5 configured of a flushing unit 14, a suction unit 15, a wiping unit 16 and an ejection performance check unit 18, providing those units for maintenance of the functional liquid droplet ejection heads 17 to perform functional maintenance and restoration for the functional liquid droplet ejection heads 17. Among the units constituting the maintenance device 5, the flushing unit 14 and ejection performance check unit 18 are mounted on the X-axis table 11, and the suction unit 15 and wiping unit 16 are set up on a pedestal 6 disposed on a position that is out of the area of the X-axis table 11 and is within the movable area of the carriage units 51 moved by the Y-axis table 12. (To be exact, the ejection performance check unit 18 includes a stage unit 77 mounted on the X-axis table 11 and a camera unit 78 supported on the Y-axis support base 3, the configuration of the above units being described below.)

The flushing unit 14 includes a pair of pre-plotting flushing units 111 and a periodic flushing unit 112, serving to receive droplets ejected for discarding (or flushing) from the functional liquid droplet ejection heads 17, the discarding being carried out immediately before ejection from the functional liquid droplet ejection heads 17 or in an intermission between plotting processes for replacement of the workpiece W or other operations. The suction unit 15 includes a plurality of divisional suction units 141, exerting forced suction on functional liquid from ejection nozzles 98 on the functional liquid droplet ejection heads 17. The wiping unit 16 includes wiping sheets 151 for wiping off a nozzle face 97 of each of the functional liquid droplet ejection heads 17 after the suction. The ejection performance check unit 18 includes a stage unit 77 having mounted thereon a check sheet 83 for receiving functional liquid droplets ejected from the functional liquid droplet ejection heads 17, and a camera unit 78 for checking the functional liquid droplets on the stage unit 77 through image recognition; it serves to check the ejection performance of the functional liquid droplet ejection heads 17 (whether functional liquid is ejected and whether the ejected functional liquid is deviated).

Components constituting the liquid droplet ejection apparatus 1 will be described hereinafter. As shown in FIGS. 1 and 2, the X-axis table 11 includes a set table 21 on which the workpiece W is to be set, a first X-axis slider 22 that supports the set table 21 so as to be slidable in the X-axis direction, a second X-axis slider 23 that supports the above flushing unit 14 and ejection performance check unit 18 so as to be slidable in the X-axis direction, a pair of right and left X-axis linear motors (not shown) which are extending in the X-axis direction, move the set table 21 (or workpiece W) in the X-axis direction with the assistance of the first X-axis slider 22 and also move the flushing unit 14 and stage unit 77 in the X-axis direction with the assistance of the second X-axis slider 23, and a pair of (or two) X-axis common support bases 24 arranged in parallel with the X-axis linear motors so as to guide the movements of the first and second X-axis sliders 22 and 23.

The set table 21 includes an adhesive table 31 on which the workpiece W is adhesively set, a θ table 32 for correcting in the θ-axis direction the position of the workpiece W that is set on the adhesive table 31, and the like. The above pre-plotting flushing units 111 are attached respectively to a pair of sides of the set table 21 the sides being in parallel with the Y-axis direction.

The Y-axis table 12 includes ten bridge plates 52 from which the ten carriage units 51 are hung respectively, ten pairs of Y-axis sliders (not shown) that support the ten bridge plates 52 at both ends, respectively, a pair of Y-axis linear motors (not shown) which are provided on the above pair of Y-axis support bases 3 and move the bridge plates 52 in the Y-axis direction with the assistance of ten pairs of Y-axis sliders. The Y-axis table 12 allows the functional liquid droplet ejection heads 17 to carry out a secondary scan through the respective carriage units 51 during plotting and to face the maintenance device 5.

With the pair of Y-axis linear motors (synchronously) driven, the respective Y-axis sliders are guided by the pair of Y-axis support bases 3 and moved in parallel simultaneously. The bridge plates 52 are thus moved in the Y-axis direction, and then the carriage units 51 are moved therewith in the Y-axis direction. In this situation, the respective carriage units 51 may be independently and individually moved, or the ten carriage units 51 may be moved as one unit by controlling the drive of the Y-axis linear motors. Thus, each of the ten carriage units 51 (or each of the head units 13) is configured so as to be independently and individually movable, which allows each of the carriage units 51 to be used for plotting and to be maintained individually.

Each of the carriage units 51 includes a head unit 13 that has a plurality of functional liquid droplet ejection heads 17, a θ-rotation mechanism 61 that supports the head unit 13 in such a manner that allows for θ-correction (θ-rotation) of the head unit 13, and a hanging member 62 that has the Y-axis table 12 (or each of the bridge plates 52) support the head unit 13 with the θ-rotation mechanism 61 therebetween.

Figure 3:
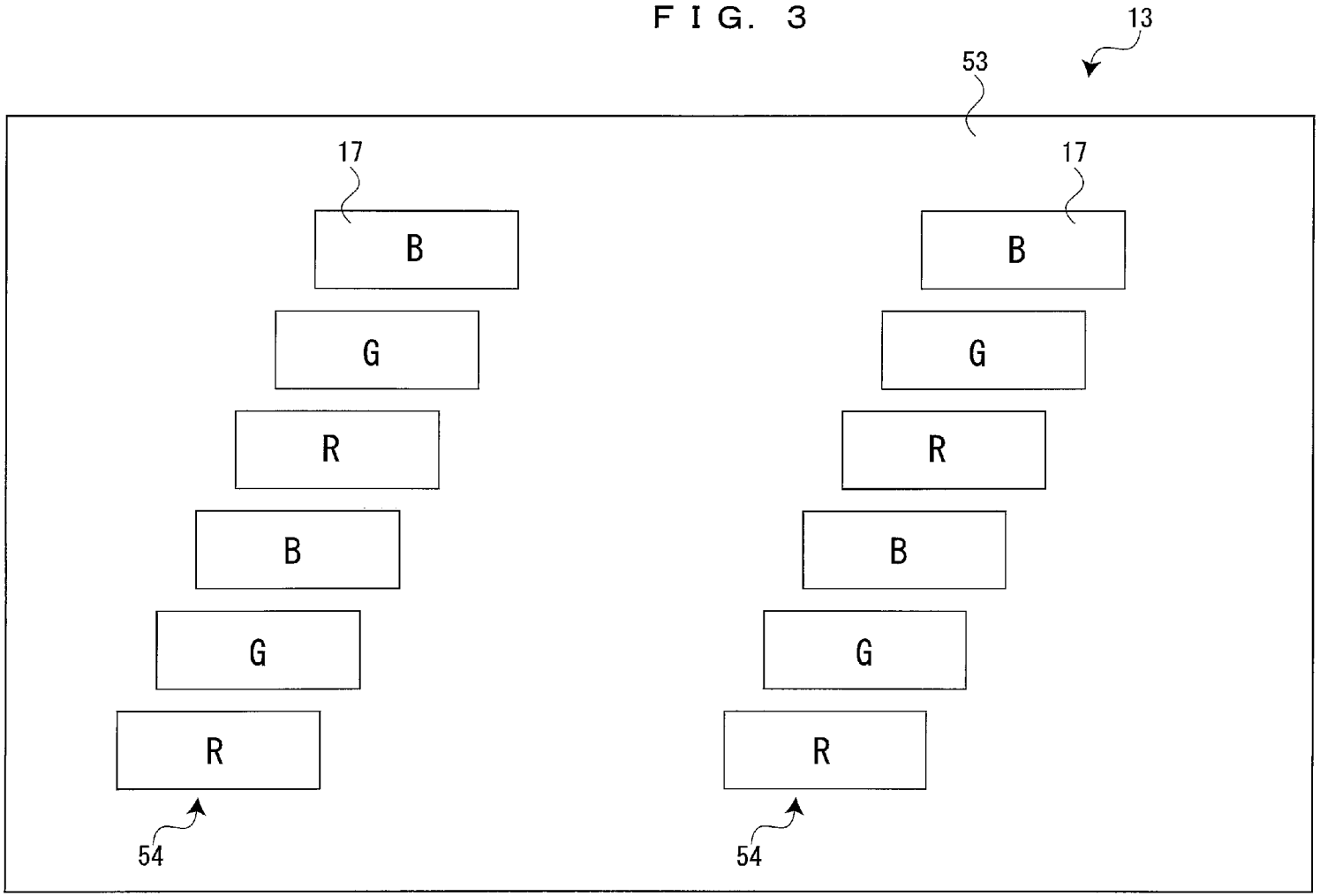
FIG. 3 is a diagram showing the arrangement and configuration of functional liquid droplet ejection heads mounted on a head unit.

As shown in FIGS. 2 and 3, the head unit 13 includes twelve functional liquid droplet ejection heads 17 and a carriage plate (carriage) 53 on which the twelve functional liquid droplet ejection heads 17 are arranged and secured. The twelve functional liquid droplet ejection heads 17 are divided into two groups in the Y-axis direction; the six functional liquid droplet ejection heads in each of the head groups 54 are arranged in the form of a staircase in the X-axis direction, constituting a head group 54. The six functional liquid droplet ejection heads 17 belonging to each head group 54 are arranged to be staggered from one another in the direction of a nozzle row 99*b*. This configuration allows arranging a plurality of functional liquid droplet ejection heads 17 on the carriage plate 53 efficiently and also allows for efficient plotting processes.

Each of ten times the twelve functional liquid droplet ejection heads 17 mounted on a head unit 13 corresponds to any of the RGB, three colors; with four functional liquid droplet ejection heads 17 for each color (two for each color in each head group 54), it is possible to plot a plurality of divisional plotted lines in respective colors on the workpiece W. The functional liquid droplet ejection heads 17 are cyclically arranged in RGB order from left to right. With the assistance of two times of secondary scans by all the (or ten times twelve) functional liquid droplet ejection heads 17, plotted lines in the RGB, three colors continuous in the Y-axis direction are formed respectively such that each of the plotted lines is constituted of a plurality of divisional plotted lines in each of the RGB, three colors. This means that there are spaces equivalent to two divisional plotted lines in length in the Y-axis direction between two functional liquid droplet ejection heads 17 for each color included in one head group 54 and two functional liquid droplet ejection heads 17 for the same color included in the other head group 54 on a head unit 13, respectively. There is also a space equivalent to two divisional plotted lines in length in the Y-axis direction between adjacent head groups 54 that are mounted on different head units 13. The length of a plotted line may be up to the width of a workpiece W in the maximum size that is mountable on the set table 21.

An arrangement configuration of twelve functional liquid droplet ejection heads 17 on the carriage plate 53 may be changed for convenience as long as each of the functional liquid droplet ejection heads 17 to be mounted on the carriage plate 53 has a plurality of nozzles 98 that are capable of forming a plurality of divisional plotted lines in respective colors, the divisional plotted lines being staggered in the Y-axis direction. For example, the twelve functional liquid droplet ejection heads 17 may be arranged in the form of a staircase without being divided into two head groups 54. Naturally, the number of functional liquid droplet ejection heads 17 mounted on each carriage unit 51 may be determined for convenience.

Figure 4:
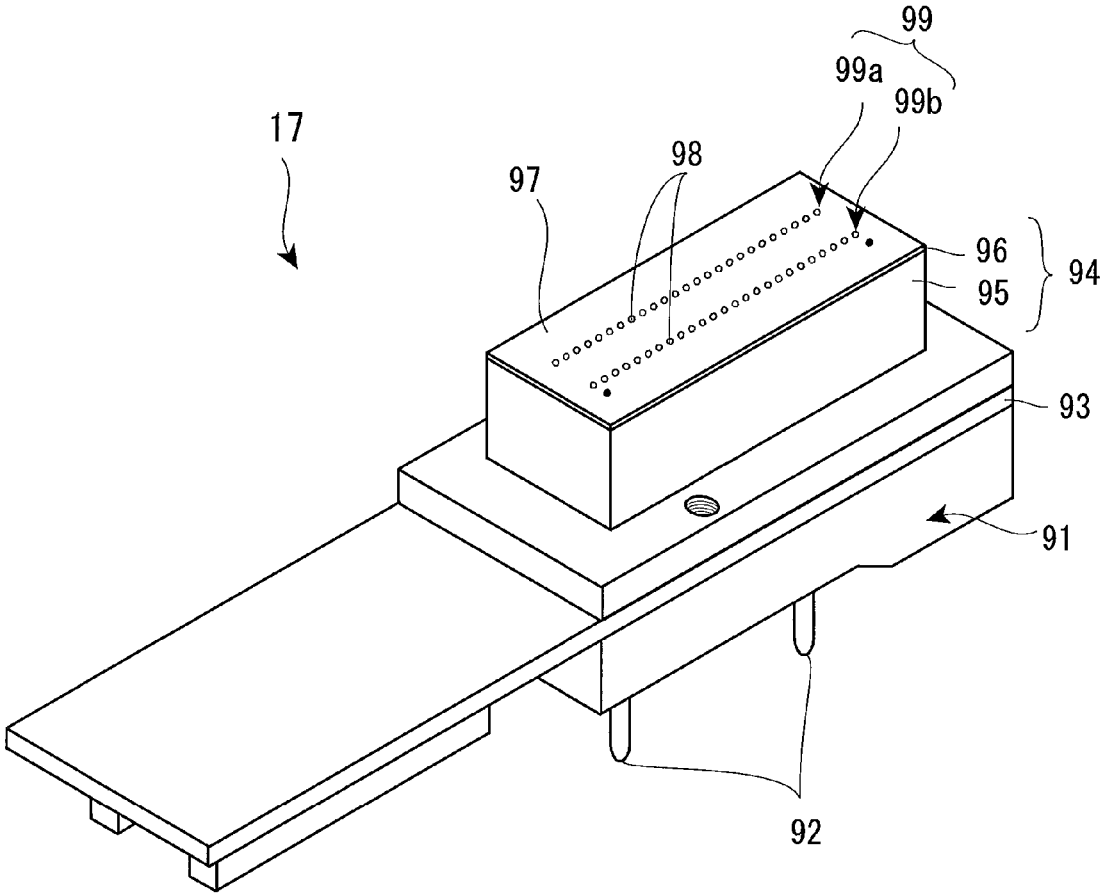
FIG. 4 is an external perspective view of a functional liquid droplet ejection head.

As shown in FIG. 4, the functional liquid droplet ejection head 17 is a so-called twin inkjet head, including a functional liquid introducer 91 having a pair of connection needles 92, a twin head substrate 93 coupled to the functional liquid introducer 91, and a head body 94 having formed therein intrahead channels which are communicating with the lower part of the functional liquid introducer 91 and filled with functional liquid. The connection needles 92 are connected to a functional liquid tank that is not shown in the drawing, and then the connection needles 92 supply functional liquid to the functional liquid introducer 91. The head body 94 is formed of a cavity 95 (piezoelectric element) and a nozzle plate 96 having a nozzle face 97 on which a number of ejection nozzles 98 are opened. When the functional liquid droplet ejection head 17 is driven for ejection, (a voltage is applied to the piezoelectric element and) functional liquid droplets are ejected from the ejection nozzles 98 by the pumping action of the cavity 95.

First and second nozzle rows 99*a* and 99*b* each configured of numerous ejection nozzles 98 are formed in parallel with one another on the nozzle face 97. The two nozzle rows 99*a* and 99*b* are staggered from each other by a half nozzle pitch. Each of the two nozzle rows 99*a* and 99*b* has ten inoperative nozzles at both respective ends, which are not used for plotting processes, whereby it is possible to suppress the variation in liquid droplet ejection volume on the nozzle rows 99*a* and 99*b* and to perform the plotting processes with higher quality. The "nozzle row" described in the appended claims means the combination of the first and second nozzle rows 99*a* and 99*b* according to the embodiment. The first and second nozzle rows 99*a* and 99*b*, therefore, are combined into one set to be referred to as nozzle row 99 hereinafter.

Figure 5A:
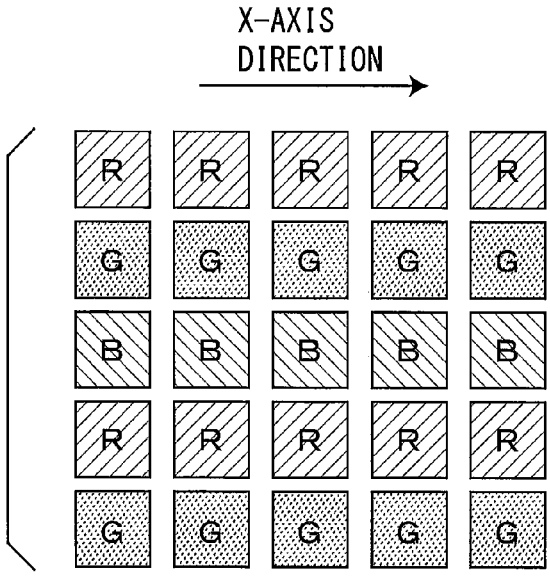
FIGS. 5A, 5B and 5C are descriptive views of coloration patterns on a color filter, FIG. 5A showing a stripe pattern, FIG. 5B showing a mosaic pattern, and FIG. 5C showing a delta pattern.
Figure 5B:
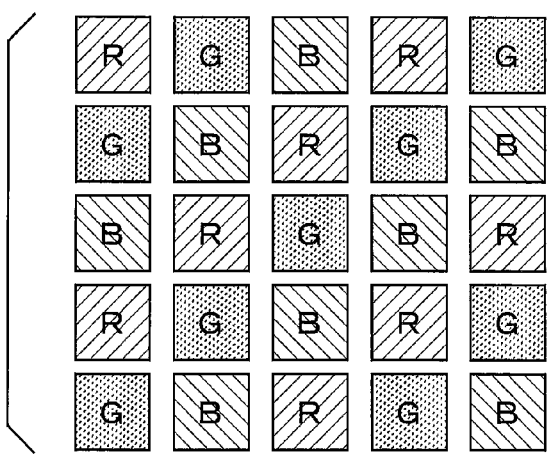
Figure 5C:
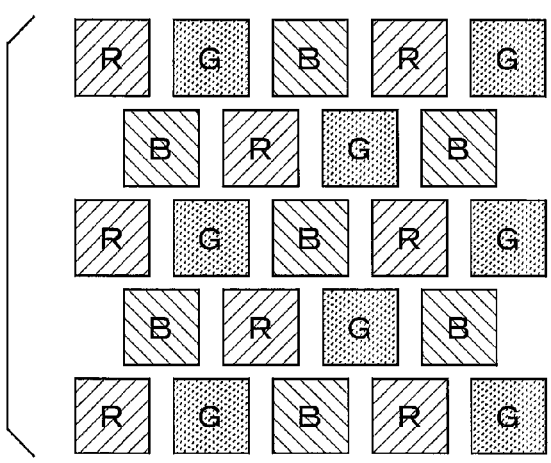

Plotting operations by the liquid droplet ejection apparatus 1 will be described hereinafter. These operations are performed with each of carriage units 51 arranged in alignment with the Y-axis direction. First, in the operations of the liquid droplet ejection apparatus 1, a first plotting operation (on the forward path) is performed while the workpiece W is moved by the X-axis table 11 (to the back side in FIG. 1) in the X-axis direction. Next, after the head units 13 are moved by a space equivalent to two heads (a divisional plotted line) in the Y-axis direction (which movement is a secondary scan), a second plotting operation (on the backward path) is performed while the workpiece W is moved (to the front side in FIG. 1) in the X-axis direction. Lastly, after the secondary scan of the head units 13 is carried out by a space equivalent to two heads (a divisional plotted line), a third plotting operation (on the forward path) is performed while the workpiece W is moved (to the back side in FIG. 1) in the X-axis direction again. Thus, the functional liquid droplet ejection heads 17 corresponding to a position on the workpiece W are changed through three primary scans and two secondary scans while movements of and plotting operations on the workpiece W are repeated; whereby an image is plotted with functional liquid in the RGB, three colors in a matrix form according to a prescribed pattern. As shown in FIGS. 5A to 5C, there are three kinds of plotting patterns that are made with functional liquid in three colors; the plotting pattern (bitmap data) shown in FIG. 5A is used for plotting in the embodiment.

Since the ten carriage units 51 carry out plotting processes with functional liquid in three colors through three primary scans and two secondary scans, ten times twelve functional liquid droplet ejection heads 17 mounted on ten carriage units 51 are arranged to be extended beyond the edges of the workpiece W in its width direction. More specifically, in a primary position (or the first plotting operation), some right ejection nozzles of the functional liquid droplet ejection heads 17 for the G and B colors mounted on the right side of the carriage unit 51 that is disposed on the right side in the ten carriage units 51 are located out of the pixel area in the Y-axis direction. In a position taken after the two times of secondary scans (or the third plotting operation), some left ejection nozzles of the functional liquid droplet ejection heads 17 for the R and G colors mounted on the left side of the carriage unit 51 that is disposed on the left side in the ten carriage units 51 are located out of the pixel area in the Y-axis direction. Thus, these functional liquid droplet ejection heads 17 are used less frequently than the other functional liquid droplet ejection heads 17 so that the head units 13 positioned on both the outer ends are used less frequently.

Figure 6:
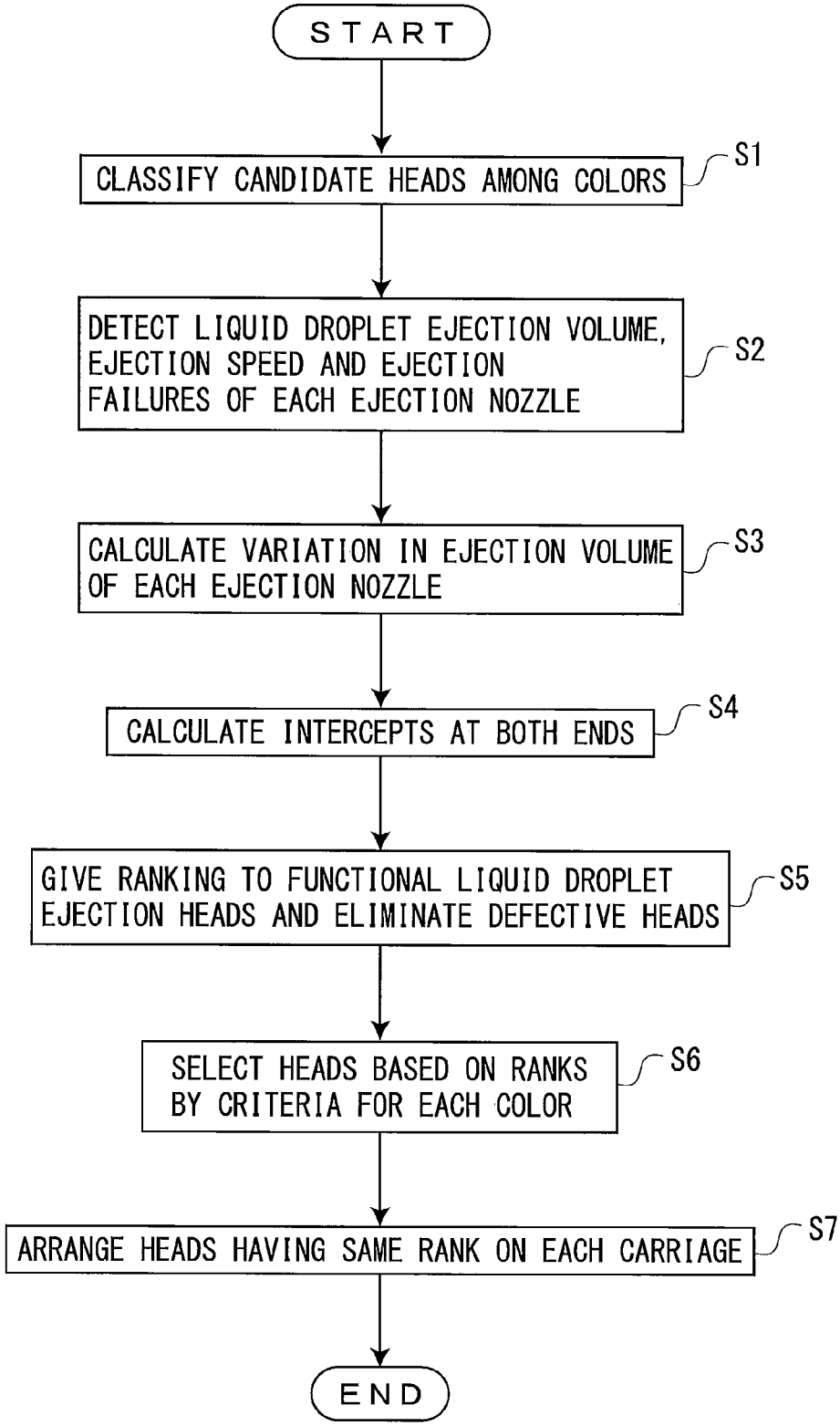
FIG. 6 is a flow chart showing operations of selecting and arranging functional liquid droplet ejection heads.
Figure 7:
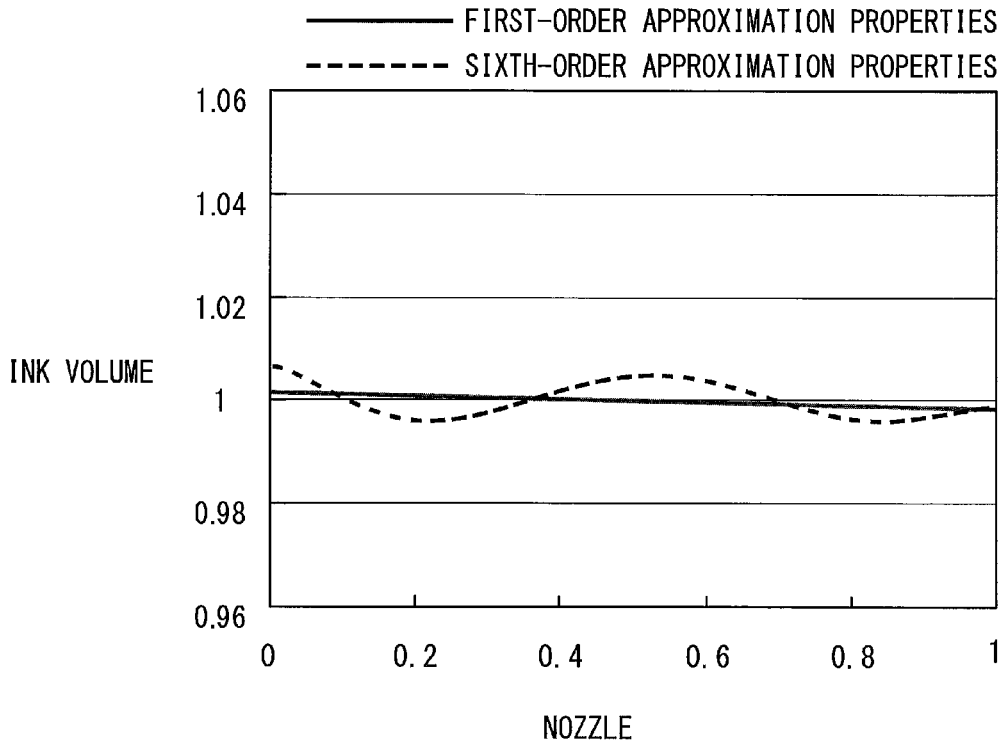
FIG. 7 is a diagram showing line graphs of approximation properties.

A method of selecting and arranging functional liquid droplet ejection heads 17 and a method of selecting and arranging carriage units 51 will be described in detail hereinafter with reference to FIGS. 6 to 10. FIG. 6 is a flow chart concerning operations of selecting and arranging functional liquid droplet ejection heads 17. In selection of functional liquid droplet ejection heads 17, the functional liquid droplet ejection heads 17 for respective colors to be mounted on carriage plates 53 are selected from numerous candidate heads that have been manufactured. In the following description, inoperative ejection nozzles that are not involved in plotting or measuring will be ignored.

As shown in FIG. 6, numerous candidate heads are classified by the colors, firstly (S1). When, for example, 300 candidate heads are manufactured, 100 candidate heads are assigned to each of the RGB, three colors. Next, the candidate heads are inspected by each color, respectively (S2).

Inspection of respective candidate heads is conducted by an inspection device that is not shown in the drawing. The inspection device detects a liquid droplet ejection volume, an ejection speed, an ejection failure and other characteristics of each ejection nozzle 98 of each candidate head. Especially, the liquid droplet ejection volume of each of all ten ejection nozzles 98 located at both respective ends is measured; that of each of the other ejection nozzles 98 (the plurality of ejection nozzles 98 located in the intermediate portion) is obtained using a approximation property line graph (shown in FIG. 7) based on the measurements of the ejection nozzles 98 located at both ends. Measurements of the liquid droplet ejection volume of ejection nozzles 98 located at both respective ends are performed in such a manner that landed liquid droplets are formed by ejecting four to six shots from the ejection nozzle 98 onto a water-repellent surface, and are dried for measuring the volume thereof by white-light interferometer or any other instrument. The liquid droplet ejection volume may be measured in such a manner that the weight of the landed liquid droplets may be measured by electronic force balance, or the volume thereof may be calculated based on image recognition results that are obtained by using an image recognition camera facing downward and/or sideward to the landed liquid droplets. As a line graph of approximation properties, a line graph of sixth-order approximation properties can be used. The above ejection failures include no ejection, deflection and abnormal ejection.

To facilitate the following comparison and calculation, the value of the obtained liquid droplet ejection volume is referred to as a percentage of an increment or decrement to a reference value with the reference value deemed 100%. For example, when the reference value is 1.05 pl and the liquid droplet ejection volume is 1.0605 pl, the value thereof is +1%, which is obtained from the following expression: $1.0605=1.05+(1.05\times0.01)=1.05+(1.05\times1\%)$; when the liquid droplet ejection volume is 1.0395 pl, the value thereof is −1%, which is obtained from the following equation: $1.0395=1.05-(1.05\times0.01)=1.05-(1.05\times1\%)$.

Next, the variation in and the intercepts of the liquid droplet ejection volume are obtained from the detected liquid droplet ejection volumes of the respective ejection nozzles 98 (S3 and S4). The variation in the liquid droplet ejection volume is a difference between the maximum and minimum of the liquid droplet ejection volume among all the ejection nozzles 98. The intercepts are differences between the liquid droplet ejection volumes of two ejection nozzles 98 located at both the ends of the nozzle row 99 and the average of the liquid droplet ejection volume among all the ejection nozzles 98. This means that two intercepts of the liquid droplet ejection volume are obtained at the right and left ends. Since the average of the liquid droplet ejection volume among all the ejection nozzles 98 is equal to the above reference value, the intercepts are equal to the liquid droplet ejection volumes of the ejection nozzles 98 located at both ends. The intercept does not take an absolute value; it is obtained with a plus or minus symbol attached thereto. As a liquid droplet ejection volume which is each of the two ejection nozzles 98 and is used to obtain the intercept, the average value of the liquid droplet ejection volumes of ten ejection nozzles 98 located at respective both the ends may be preferably used. Consequently, it is possible to diminish the variation in the liquid droplet ejection volume of one ejection nozzle 98 and to accurately perform the comparison and calculation concerning the intercept which will be described below.

When the variation in the liquid droplet ejection volume and the intercepts thereof at both the ends are obtained, each of the candidate heads is given a rank of S, A or B and defective heads are eliminated depending on the obtained result (S5). The ranking of each candidate head is given depending on whether conditions of a variation range and intercept range are satisfied. The condition of the variation range is a condition under which the variation in the liquid droplet ejection volume is within the variation range set for each rank, and the condition of the intercept range is a condition under which the absolute value of each of the intercepts of the liquid droplet ejection volume is within the permissible range set for each rank. For the rank S, the variation range is set at 2% or below; the permissible range of the intercept is set at 0.65% or below. In other words, a candidate head whose variation is 2% or below and the absolute value of each of whose intercepts is 0.65% or below is given the rank S. For the rank A, the variation range is set at 2.5% or below; the permissible range of the intercept is set at 0.9% or below. For the rank B, the variation range is set at 3% or below; the permissible range of the intercept is set at ∞% (or is not limited).

Candidate heads that are not given any of the ranks S, A or B (or whose variation is over 3%) and candidate heads in which ejection failure is detected by the above inspection are eliminated as defective heads. When, for example, 20 of 100 candidate heads assigned to the color B are given the rank S, 40 thereof are given the rank A, and 30 thereof are given the rank B, 10 thereof are identified as defective heads. In this situation, the 10 candidate heads are eliminated as defective heads, and then each of the 90 candidate heads is left as the head with its rank. The rank that is thus given is obtained as a liquid droplet ejection volume property of each candidate head.

Next, a plurality of functional liquid droplet ejection heads 17 to be mounted on the carriage units 51 are selected from the candidate heads depending on the ranks (liquid droplet ejection volume properties) (S6). Selection of functional liquid droplet ejection heads 17 is made by selection criteria that are set depending on a correlation between the liquid droplet ejection volume property (rank) of a candidate head and the degree of occurrence of color variation in each color. More specifically, since color variation occurs more frequently to the B color, ranks acceptable to the B color are the ranks S and A, and ranks acceptable to the R and G colors are all the ranks. For the B color, candidate heads with the rank S or A are selected as functional liquid droplet ejection heads 17 to be mounted. At this moment, candidate heads that do not satisfy the selection criteria (acceptable ranks) are eliminated. The candidate heads that have been eliminated may be used as candidate heads for other colors. As the correlation between the liquid droplet ejection volume property and the degree of occurrence of color variation in each color described herein, a correlation between the liquid droplet ejection volume property of a candidate head (functional liquid droplet ejection head 17) and the degree of occurrence of visible color variation in each color in a finished product which is obtained by experiment, is used. This means that data of the correlation is varied depending on the finished product to be used, so that the selection criteria are not limited to the above selection criteria.

When functional liquid droplet ejection heads 17 are selected for each color, the functional liquid droplet ejection heads 17 are arranged and mounted on respective carriage units 51 (S7). The respective carriage units 51 described herein are not the ten carriage units 51 to be mounted on the apparatus, but numerous candidate carriage units that are subject to selection of ten carriage units 51. The candidate head units described in the appended claims are head units 13 mounted on the candidate carriage units; to be exact, they are to be equipped with functional liquid droplet ejection heads 17 for respective colors.

As well as the carriage units 51, each candidate carriage unit is equipped with four functional liquid droplet ejection heads 17 for each color: twelve totally. At this moment, the respective functional liquid droplet ejection heads 17 are arranged in positions determined for respective colors (as shown in FIG. 3); candidate carriage units for any color are arranged and mounted on candidate carriage units having the same rank on a candidate carriage unit irrespective of the colors. For example, functional liquid droplet ejection heads 17 for respective colors having a high rank are mounted on the same candidate carriage units; functional liquid droplet ejection heads 17 for respective colors having a low rank are mounted on the same candidate carriage units. When the respective functional liquid droplet ejection heads 17 are mounted on the candidate carriage units, the ejection property information (rank, variation and intercepts) of each of the functional liquid droplet ejection heads 17 is packed as information for the candidate carriage unit equipped therewith.

Figure 8:
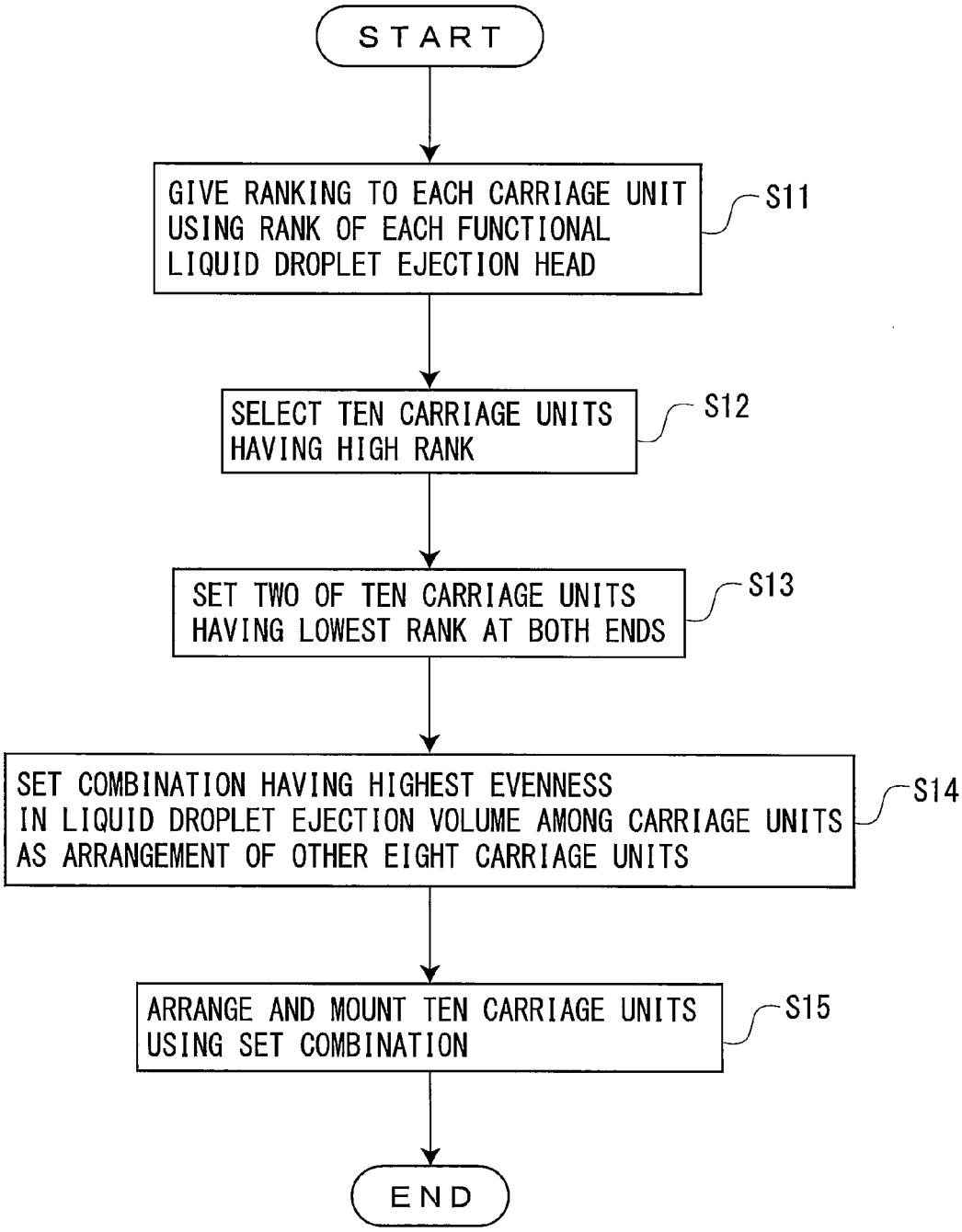
FIG. 8 is a flow chart showing operations of selecting and arranging carriage units.
Figure 9:
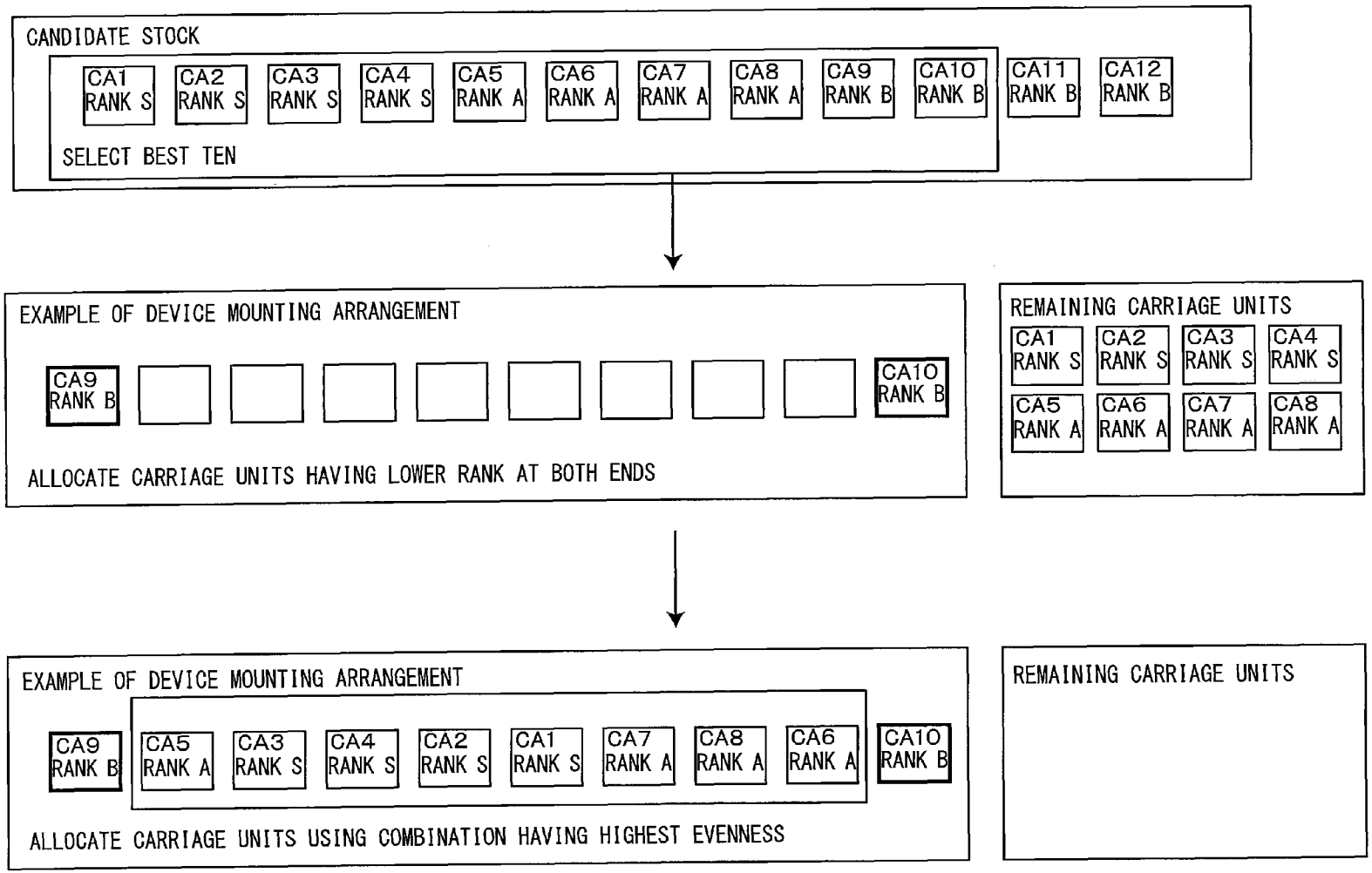
FIG. 9 is a descriptive diagram showing operations of arranging carriage units.

Next, a method of selecting and arranging ten carriage units 51 will be described hereinafter with reference to FIGS. 8 and 9. Through the following operations of selecting and arranging carriage units 51, head units 13 to be mounted on the carriage units 51 are selected and arranged. FIG. 8 is a flow chart concerning operations of selecting and arranging carriage units 51. As shown in FIG. 8, ranking is given to respective candidate carriage units (S11). Ranking is given using the ranks included in the ejection performance information of respective functional liquid droplet ejection heads 17, the information being packed in respective candidate carriage units. This means that a rank given to each candidate carriage unit is set at the lowest rank (S>A>B) given to the functional liquid droplet ejection heads 17 mounted thereon. Thus, a rank S, A or B is given to each candidate carriage unit.

When a rank is given, ten carriage units 51 are selected from numerous candidate carriage units based on the rank. Ten of all candidate carriage units having the highest ranks are selected as ten carriage units 51 to be mounted on the liquid droplet ejection apparatus 1. When carriage units 51 tenth and eleventh ranks from highest to lowest are the same, they are ranked in descending order by accuracy using the variation and intercepts of each mounted functional liquid droplet ejection head 17 to select a carriage unit 51 having the higher rank (or higher accuracy). More accurate plotting may be achieved by selecting for use carriage units 51 (head units 13) exhibiting higher liquid droplet ejection performance (ranks) from numerous candidate carriage units (candidate head units) that are candidates for mounting.

Next, (the order of) arrangement of the ten selected carriage units 51 is determined. The ten carriage units 51 are arranged in alignment with the Y-axis direction; two of the ten carriage units 51 that have the lowest rank are arranged at both ends first, as shown in FIG. 9 (S13). Thus, two carriage units 51 (head units 13) exhibiting the lowest liquid droplet ejection performance (rank) are arranged at both ends; whereby carriage units 51 exhibiting lower liquid droplet ejection performance are allocated to both ends at which they are used less frequently and the degree of occurrence of color variation is low. This allows arranging carriage units 51 properly and using efficiently carriage units 51 exhibiting higher liquid droplet ejection performance. This also allows preventing color variation, resulting in accurate plotting.

Ranking is given to respective functional liquid droplet ejection heads 17 using the conditions of the variation range and intercept range; carriage units 51 (head units 13) are evaluated on the basis of their ranks, which allows evaluating carriage units 51 accurately and properly. The use of ranks facilitates comparison of respective functional liquid droplet ejection heads 17.

The lowest of the ranks given to respective functional liquid droplet ejection heads 17 that is closely connected to occurrence of color variation is evaluated as liquid droplet ejection performance, which allows evaluating the liquid droplet ejection performance of a carriage unit 51 (head unit 13) properly and accurately. Carriage units 51 are evaluated by the lowest rank, which allows comparing respective carriage units easily.

Next, (the order of) arrangement of the other eight carriage units 51 excluding two positioned at both ends is determined as follows. When ten positions of the ten carriage units 51 are respectively referred to as A1, A2, through A10, the difference between the intercepts of carriage units 51 located at seven boundaries between A2 and A3, A3 and A4, A4 and A5, A5 and A6, A6 and A7, A7 and A8, and A8 and A9 in the order (pattern) of arrangement of the eight carriage units 51 is calculated.

When two head units 13 located at a boundary are referred to as left and right head units, and twelve functional liquid droplet ejection heads 17 mounted on each head unit 13 are referred to as a head 1, a head 2, through a head 12 from left to right, the difference between the intercepts obtained at each boundary is calculated from the intercepts obtained at the right end of the functional liquid droplet ejection heads 17 for respective colors which are positioned at the right end on the left head unit (head 10 for R color, head 11 for G color and head 12 for B color), and the intercepts obtained at the left end of the functional liquid droplet ejection heads 17 for respective colors which are positioned at the left end on the right head unit (head 1 for R color, head 2 for G color and head 3 for B color). This means that with a difference between two intercepts (an intercept difference) obtained for each color, the largest of the three intercept differences obtained for the RGB, three colors is used as an intercept difference. When the intercepts obtained at the right end of the heads 10, 11 and 12 mounted on the left head unit are +0.52%, +0.31% and −0.64% and the intercepts obtained at the left end of the heads 1, 2, and 3 mounted on the right head unit are +0.07%, +0.55% and −0.33%, for example, the intercept differences obtained for respective colors are: (R, G, B)=(0.45%, 0.24%, 0.31%). The largest of the values that is 0.45% for the color R is referred to as an intercept difference at the boundary.

Figure 10:
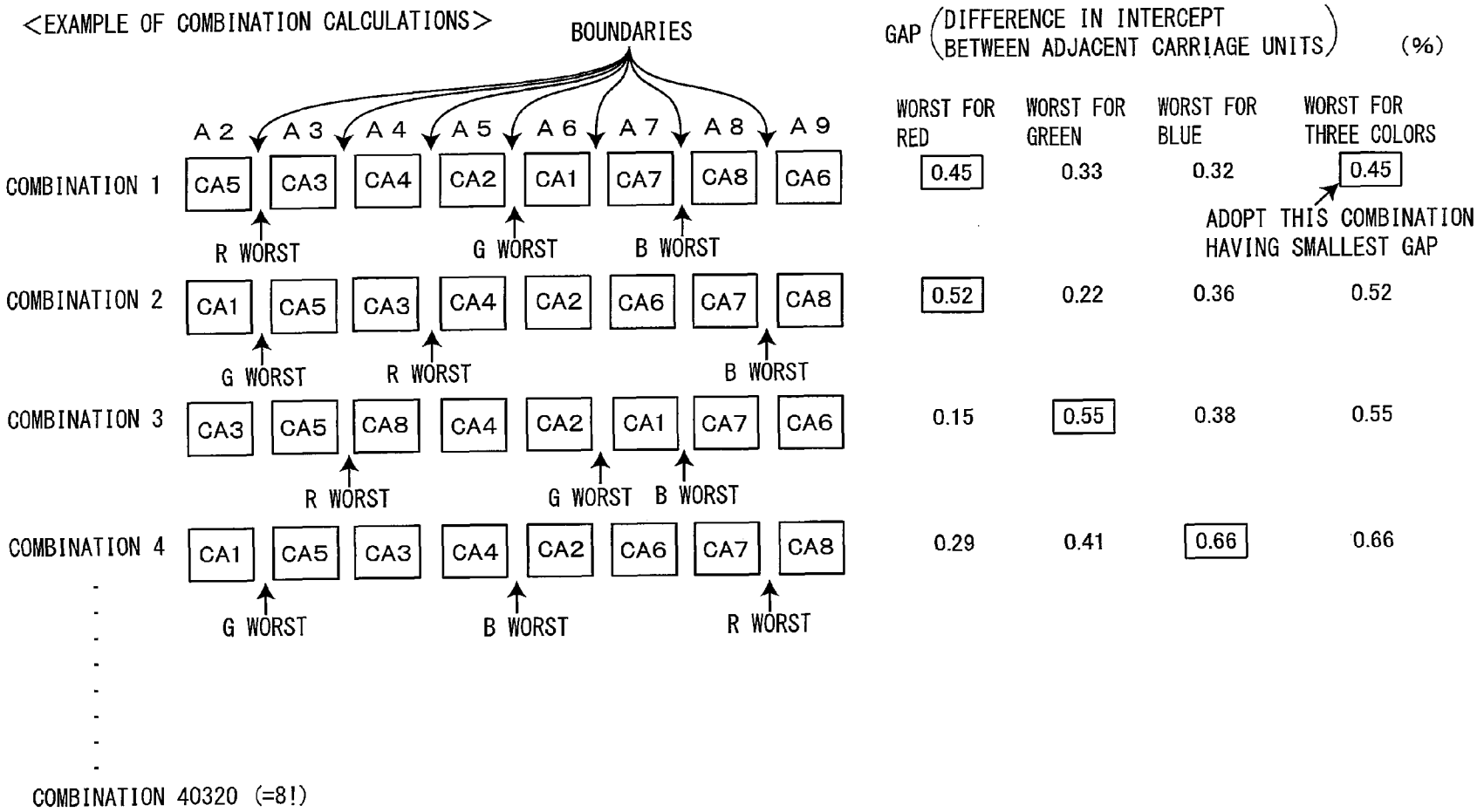
FIG. 10 is a diagram showing an example of calculations for combinations of carriage units to be positioned in an intermediate portion.

Next, the evenness in the liquid droplet ejection volume between carriage units 51 in each type of arrangement order is evaluated using the intercept differences at the respective boundaries. The evenness in the liquid droplet ejection volume is the degree of difference in the liquid droplet ejection volume between head units 13. It is highly evaluated when the maximum among the intercept differences obtained at the seven boundaries is small, while it is lowly evaluated when the maximum among the intercept differences obtained at the seven boundaries is great. One of all the types of arrangement order that has the most-highly evaluated evenness is selected as arrangement of eight carriage units 51 to be positioned in the intermediate portion. In other words, the arrangement order having the smallest maximum among the intercept differences at the seven boundaries is selected as arrangement of carriage units 51 to be positioned in the intermediate portion (S14). According to the selected arrangement, ten carriage units 51 are mounted on (the Y-axis table 12 of) the liquid droplet ejection apparatus 1 (S15). In the embodiment, the maximum of the intercepts calculated for respective colors at each boundary is obtained, and the maximum value among the maximums obtained at the respective boundary is used for evaluation of the evenness in the liquid droplet ejection volume; as shown in FIG. 10, however, it is possible to obtain for each color the maximum among the intercepts at respective boundaries and use the maximum value among the three maximums obtained for the respective colors for evaluation of the evenness in the liquid droplet ejection volume.

Thus, it is possible to evaluate the evenness in the liquid droplet ejection volume between carriage units 51 (head units 13) based on the difference in the liquid droplet ejection volume between nearest ejection nozzles 98 for each color disposed on different adjacent head units, arrange respective carriage units 51 so that a combination thereof may exhibit the greatest evenness in the liquid droplet ejection volume, thereby diminishing differences in the liquid droplet ejection volume among the carriage units 51. This allows preventing color variation and streaking, resulting in more accurate plotting.

It is also possible to evaluate accurately and properly the evenness in the liquid droplet ejection volume based on the maximum among the differences in the liquid droplet ejection volume obtained for all colors at all seven boundaries (the number of which differences is seven times three).

With the above configuration, it is possible to arrange two head units 13 exhibiting the lowest liquid droplet ejection performance at both ends of an alignment of multiple head units 13, thereby allocating the head units 13 exhibiting lower liquid droplet ejection performance to both the ends at which they are used less frequently and so does color variation occur. This allows arranging head units 13 properly and using efficiently head units 13 exhibiting higher liquid droplet ejection performance. This also allows preventing color variation, resulting in accurate plotting.

It is also possible to improve the yield of a workpiece W by using the method of arranging head units 13 which the method allows for accurate plotting.

As the method of arranging the carriage units 51 (head units 13), (a) the carriage units 51 with respective lower ranks are arranged at both ends, and (b) carriage units 51 in a combination which may exhibit the great evenness in the liquid droplet ejection volume are arranged to be positioned in the intermediate portion; however, the carriage units 51 may be arranged under only any one of the above conditions (a) and (b).

In the embodiment, selection and arrangement are performed by a unit of a carriage unit 51; however, it may be performed by a unit of a head unit 13.

The liquid droplet ejection apparatus 1 according to the embodiment includes ten carriage units 51; however the number of carriage units 51 may be determined for convenience.

In the embodiment, while the invention is applied to the functional liquid droplet ejection apparatus 1 using functional liquid in RGB (red, green and blue), three colors; the number of colors and types of functional liquid are not limited thereto. For example, the invention may be applied to an apparatus using functional liquid in CMY (cyan, magenta and yellow), three colors or in RGB and CMY, six colors. When functional liquid in six (or a number n of) colors is used, plotting on a workpiece with functional liquid in six (or the number n of) colors is performed through six (or the number n of) primary scans and five (or a number [n−1] of) secondary scans.

Taking electro-optical apparatuses (flat panel display apparatuses) manufactured using the liquid droplet ejection apparatus 1 and active matrix substrates formed on the electro-optical apparatuses as display apparatuses as examples, configurations and manufacturing methods thereof will now be described. Examples of the electro-optical apparatuses include a color filter, a liquid crystal display apparatus, an organic EL apparatus, a plasma display apparatus (PDP (plasma display panel) apparatus), and an electron emission apparatus (FED (field emission display) apparatus and SED (surface-conduction electron emitter display) apparatus). Note that the active matrix substrate includes thin-film transistors, source lines and data lines which are electrically connected to the thin film transistors.

Figure 11:
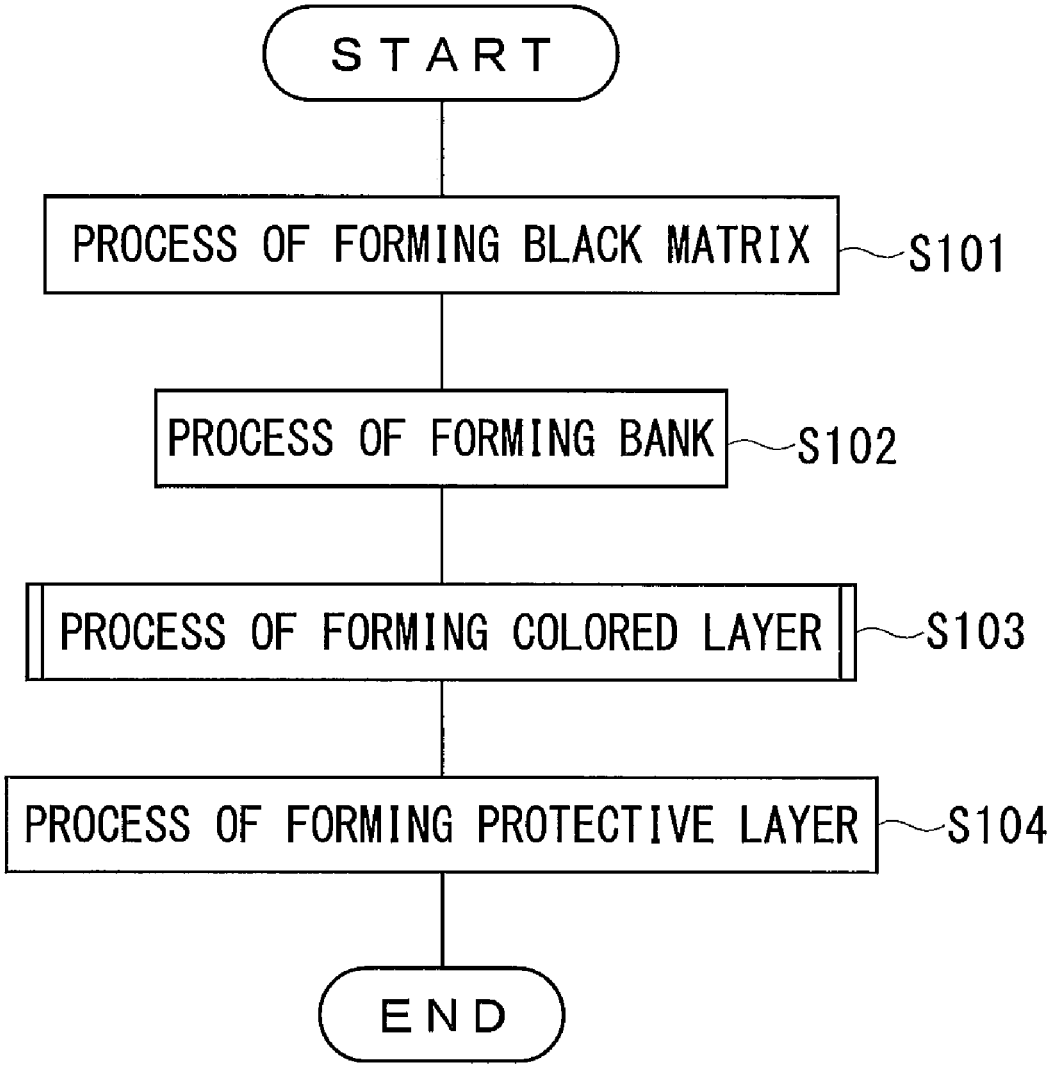
FIG. 11 is a flow chart illustrating processes of manufacturing a color filter.

First, a manufacturing method of a color filter incorporated in a liquid crystal display apparatus or an organic EL apparatus will be described. FIG. 11 shows a flowchart illustrating manufacturing steps of a color filter. FIGS. 12A to 12E are sectional views of the color filter 500 (a filter substrate 500A) of this embodiment shown in an order of the manufacturing steps.

Figure 12A:
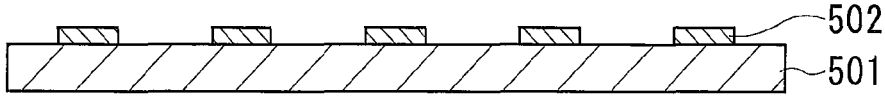
FIGS. 12A to 12E are schematic sectional views of a color filter shown in order of manufacture process.

In a black matrix forming step (step S101), as shown in FIG. 12A, a black matrix 502 is formed on the substrate (W) 501. The black matrix 502 is formed of a chromium metal, a laminated body of a chromium metal and a chromium oxide, or a resin black, for example. The black matrix 502 may be formed of a thin metal film by a sputtering method or a vapor deposition method. Alternatively, the black matrix 502 may be formed of a thin resin film by a gravure plotting method, a photoresist method, or a thermal transfer method.

Figure 12B:
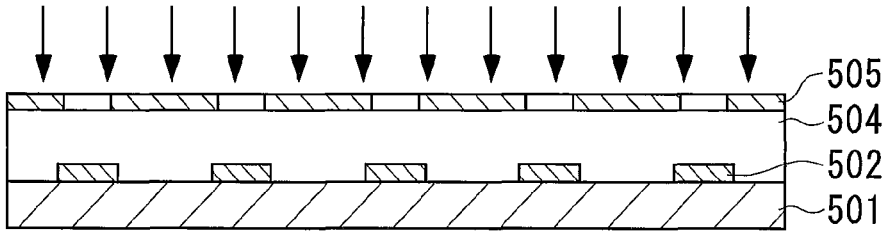

In a bank forming step (step S102), the bank 503 is formed so as to be superposed on the black matrix 502. Specifically, as shown in FIG. 12B, a resist layer 504 which is formed of a transparent negative photosensitive resin is formed so as to cover the substrate 501 and the black matrix 502. An upper surface of the resist layer 504 is covered with a mask film 505 formed in a matrix pattern. In this state, exposure processing is performed.

Figure 12C:
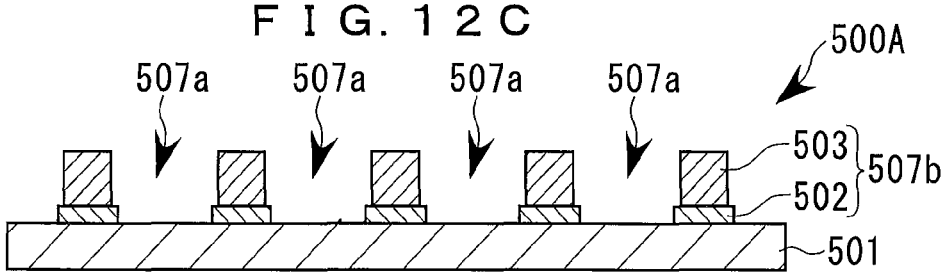

Furthermore, as shown in FIG. 12C, the resist layer 504 is patterned by performing etching processing on portions of the resist layer 504 which are not exposed, and the bank 503 is thus formed. Note that when the black matrix 502 is formed of a resin black, the black matrix 502 also serves as a bank.

The bank 503 and the black matrix 502 disposed beneath the bank 503 serve as a partition wall 507*b* for partitioning the pixel areas 507*a*. The partition wall 507*b* defines receiving areas for receiving the functional liquid ejected when the functional liquid droplet ejection heads 17 form coloring layers (film portions) 508R, 508G, and 508B in a subsequent coloring layer forming step.

The filter substrate 500A is obtained through the black matrix forming step and the bank forming step.

Note that, in this embodiment, a resin material having a lyophobic (hydrophobic) film surface is used as a material of the bank 503. Since a surface of the substrate (glass substrate) 501 is lyophilic (hydrophilic), variation of positions to which the liquid droplet is projected in the each of the pixel areas 507*a* surrounded by the bank 503 (partition wall 507*b*) can be automatically corrected in the subsequent coloring layer forming step.

Figure 12D:
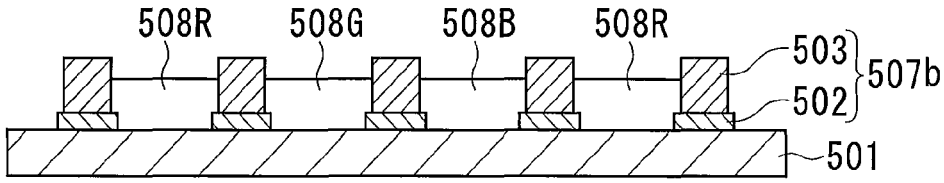

In the coloring layer forming step (S103), as shown in FIG. 12D, the functional liquid droplet ejection heads 17 eject the functional liquid within the pixel areas 507*a* each of which are surrounded by the partition wall 507*b*. In this case, the functional liquid droplet ejection heads 17 eject functional liquid droplets using functional liquid (filter materials) of colors R, G, and B. A color scheme pattern of the three colors R, G, and B may be the stripe arrangement, the mosaic arrangement, or the delta arrangement.

Figure 12E:
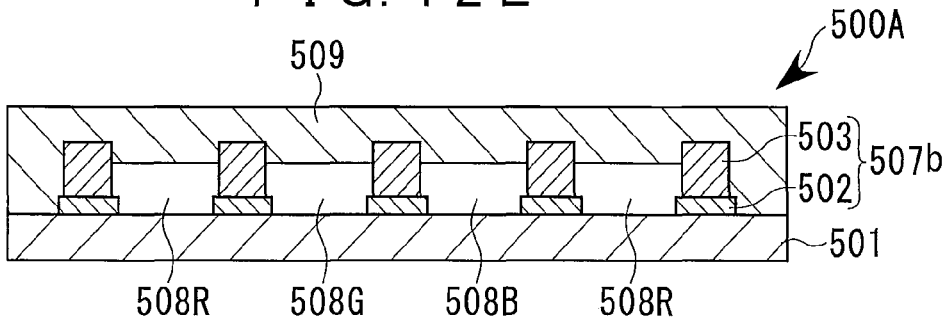

Then drying processing (such as heat treatment) is performed so that the three color functional liquid are fixed, and thus three coloring layers 508R, 508G, and 508B are formed. Thereafter, a protective film forming step is reached (step S104). As shown in FIG. 12E, a protective film 509 is formed so as to cover surfaces of the substrate 501, the partition wall 507*b*, and the three coloring layers 508R, 508G, and 508B.

That is, after liquid used for the protective film is ejected onto the entire surface of the substrate 501 on which the coloring layers 508R, 508G, and 508B are formed and the drying process is performed, the protective film 509 is formed.

In the manufacturing method of the color filter 500, after the protective film 509 is formed, a coating step is performed in which ITO (Indium Tin Oxide) serving as a transparent electrode in the subsequent step is coated.

Figure 13:
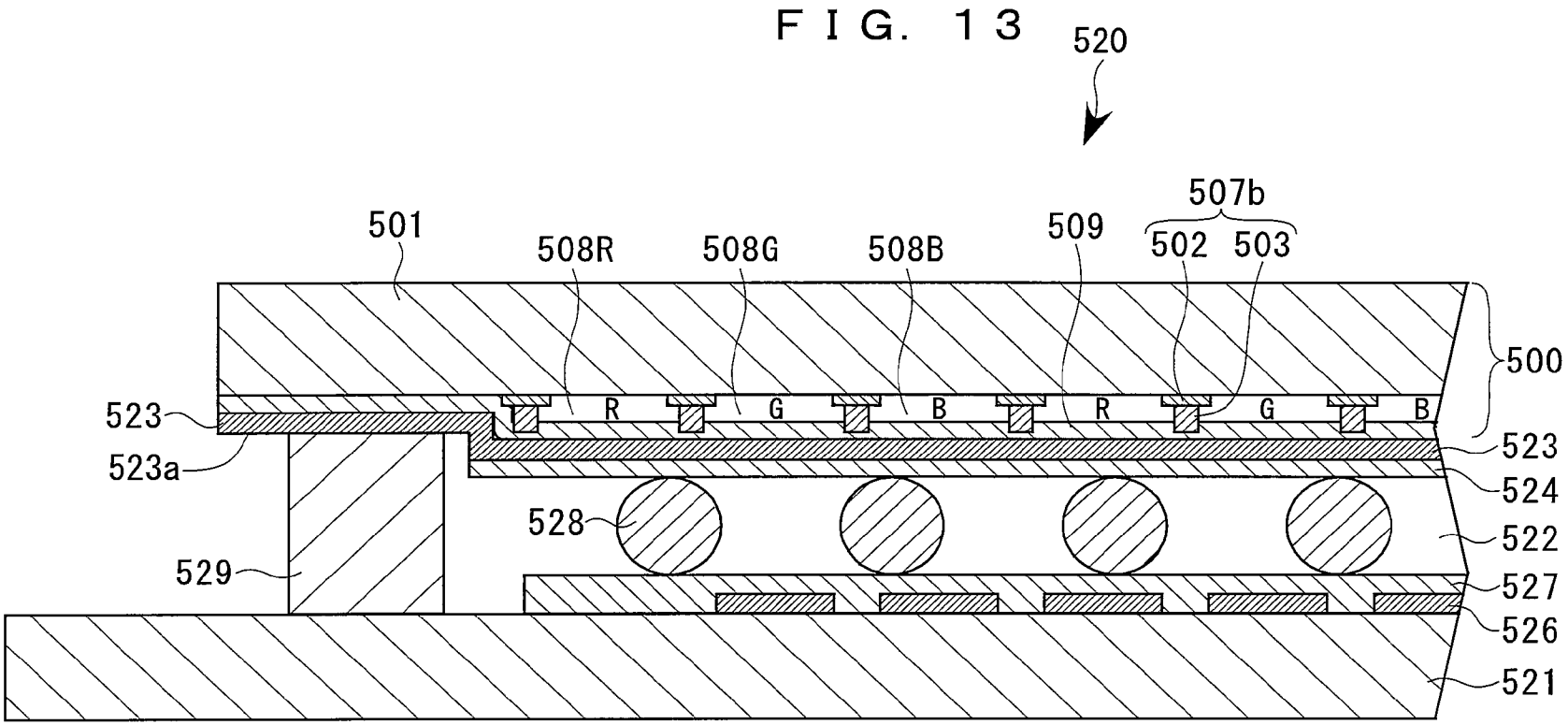
FIG. 13 is a sectional view showing a main part of a schematic configuration of a liquid crystal display using a color filter to which the invention is applied.

FIG. 13 is a sectional view of an essential part of a passive matrix liquid crystal display device (liquid crystal display device 520) and schematically illustrates a configuration thereof as an example of a liquid crystal display device employing the color filter 500. A transmissive liquid crystal display device as a final product can be obtained by disposing a liquid crystal driving IC (integrated circuit), a backlight, and additional components such as supporting members on the display device 520. Note that the color filter 500 is the same as that shown in FIGS. 12A to 12E, and therefore, reference numerals the same as those used in FIGS. 6A to 6E to denote the same components, and descriptions thereof are omitted.

The display device 520 includes the color filter 500, a counter substrate 521 such as a glass substrate, and a liquid crystal layer 522 formed of STN (super twisted nematic) liquid crystal compositions sandwiched therebetween. The color filter 500 is disposed on the upper side of FIG. 7 (on an observer side).

Although not shown, polarizing plates are disposed so as to face an outer surface of the counter substrate 521 and an outer surface of the color filter 500 (surfaces which are remote from the liquid crystal layer 522). A backlight is disposed so as to face an outer surface of the polarizing plate disposed near the counter substrate 521.

A plurality of rectangular first electrodes 523 extending in a horizontal direction in FIG. 13 are formed with predetermined intervals therebetween on a surface of the protective film 509 (near the liquid crystal layer 522) of the color filter 500. A first alignment layer 524 is arranged so as to cover surfaces of the first electrodes 523 which are surfaces remote from the color filter 500.

On the other hand, a plurality of rectangular second electrodes 526 extending in a direction perpendicular to the first electrodes 523 disposed on the color filter 500 are formed with predetermined intervals therebetween on a surface of the counter substrate 521 which faces the color filter 500. A second alignment layer 527 is arranged so as to cover surfaces of the second electrodes 526 near the liquid crystal layer 522. The first electrodes 523 and the second electrodes 526 are formed of a transparent conductive material such as an ITO.

A plurality of spacers 528 disposed in the liquid crystal layer 522 are used to maintain the thickness (cell gap) of the liquid crystal layer 522 constant. A seal member 529 is used to prevent the liquid crystal compositions in the liquid crystal layer 522 from leaking to the outside. Note that an end of each of the first electrodes 523 extends beyond the seal member 529 and serves as wiring 523*a*.

Pixels are arranged at intersections of the first electrodes 523 and the second electrodes 526. The coloring layers 508R, 508G, and 508B are arranged on the color filter 500 so as to correspond to the pixels.

In normal manufacturing processing, the first electrodes 523 are patterned and the first alignment layer 524 is applied on the color filter 500 whereby a first half portion of the display device 520 on the color filter 500 side is manufactured. Similarly, the second electrodes 526 are patterned and the second alignment layer 527 is applied on the counter substrate 521 whereby a second half portion of the display device 520 on the counter substrate 521 side is manufactured. Thereafter, the spacers 528 and the seal member 529 are formed on the second half portion, and the first half portion is attached to the second half portion. Then, liquid crystal to be included in the liquid crystal layer 522 is injected from an inlet of the seal member 529, and the inlet is sealed. Finally, the polarizing plates and the backlight are disposed.

The liquid droplet ejection apparatus 1 of this embodiment may apply a spacer material (functional liquid) constituting the cell gap, for example, and uniformly apply liquid crystal (functional liquid) to an area sealed by the seal member 529 before the first half portion is attached to the second half portion. Furthermore, the seal member 529 may be printed using the functional liquid droplet ejection heads 17. Moreover, the first alignment layer 524 and the second alignment layer 527 may be applied using the functional liquid droplet ejection heads 17.

Figure 14:
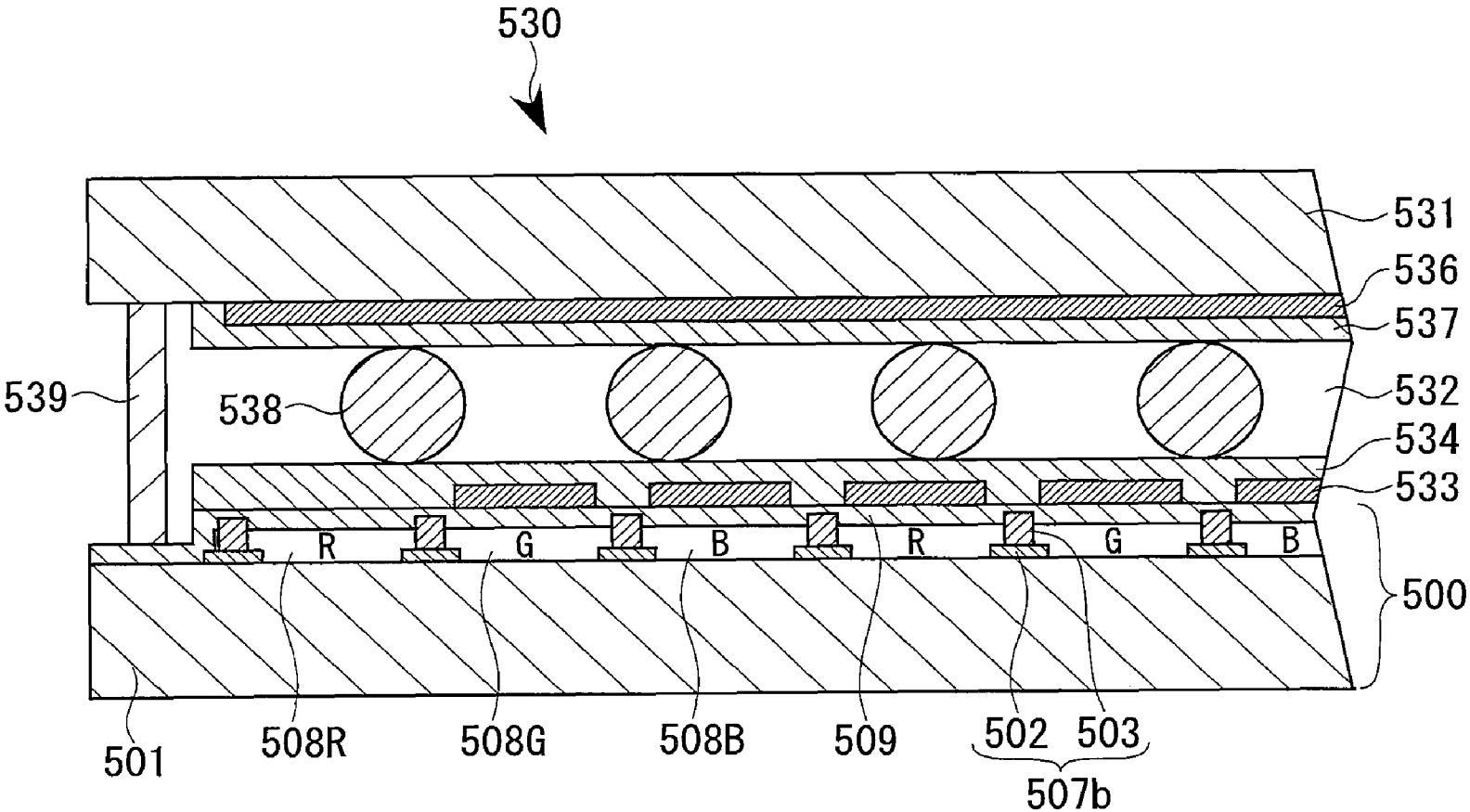
FIG. 14 is a sectional view showing a main part of a schematic configuration of a second exemplary liquid crystal display using a color filter to which the invention is applied.

FIG. 14 is a sectional view of an essential part of a display device 530 and schematically illustrates a configuration thereof as a second example of a liquid crystal display device employing the color filter 500 which is manufactured in this embodiment.

The display device 530 is considerably different from the display device 520 in that the color filter 500 is disposed on a lower side in FIG. 14 (remote from the observer).

The display device 530 is substantially configured such that a liquid crystal layer 532 constituted by STN liquid crystal is arranged between the color filter 500 and a counter substrate 531 such as a glass substrate. Although not shown, polarizing plates are disposed so as to face an outer surface of the counter substrate 531 and an outer surface of the color filter 500.

A plurality of rectangular first electrodes 533 extending in a depth direction of FIG. 14 are formed with predetermined intervals therebetween on a surface of the protective film 509 (near the liquid crystal layer 532) of the color filter 500. A first alignment layer 534 is arranged so as to cover surfaces of the first electrodes 533 which are surfaces near the liquid crystal layer 532.

On the other hand, a plurality of rectangular second electrodes 536 extending in a direction perpendicular to the first electrodes 533 disposed on the color filter 500 are formed with predetermined intervals therebetween on a surface of the counter substrate 531 which faces the color filter 500. A second alignment layer 537 is arranged so as to cover surfaces of the second electrodes 536 near the liquid crystal layer 532.

A plurality of spacers 538 disposed in the liquid crystal layer 532 are used to maintain the thickness (cell gap) of the liquid crystal layer 532 constant. A seal member 539 is used to prevent the liquid crystal compositions in the liquid crystal layer 532 from leaking to the outside.

As with the display device 520, pixels are arranged at intersections of the first electrodes 533 and the second electrodes 536. The coloring layers 508R, 508G, and 508B are arranged on the color filter 500 so as to correspond to the pixels.

Figure 15:
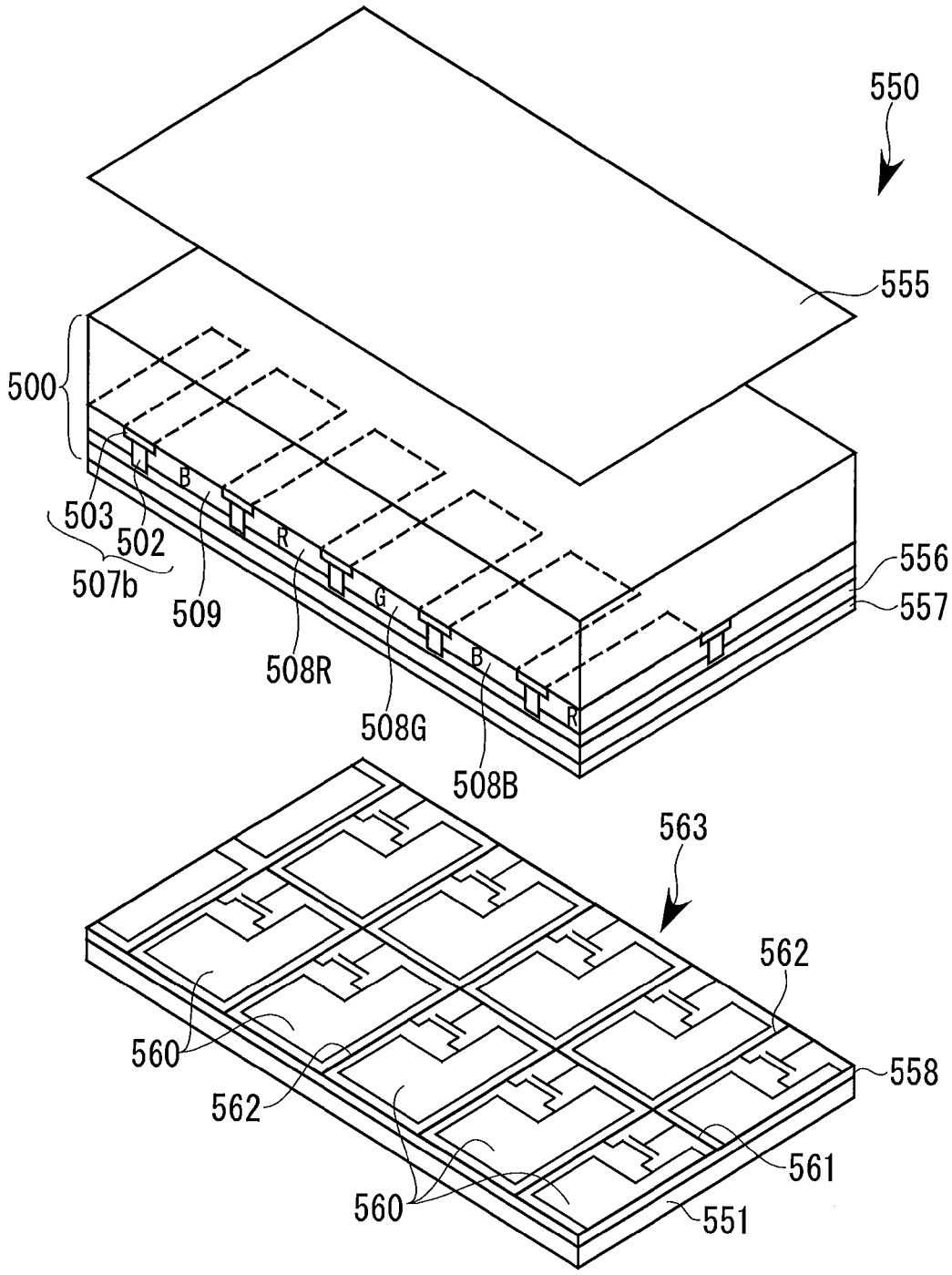
FIG. 15 is a sectional view showing a main part of a schematic configuration of a third exemplary liquid crystal display using a color filter to which the invention is applied.

FIG. 15 is an exploded perspective view of a transmissive TFT (thin film transistor) liquid crystal display device and schematically illustrates a configuration thereof as a third example of a liquid crystal display device employing the color filter 500 to which the invention is applied.

A liquid crystal display device 550 has the color filter 500 disposed on the upper side of FIG. 15 (on the observer side).

The liquid crystal display device 550 includes the color filter 500, a counter substrate 551 disposed so as to face the color filter 500, a liquid crystal layer (not shown) interposed therebetween, a polarizing plate 555 disposed so as to face an upper surface of the color filter 500 (on the observer side), and a polarizing plate (not shown) disposed so as to face a lower surface of the counter substrate 551.

An electrode 556 used for driving the liquid crystal is formed on a surface of the protective film 509 (a surface near the counter substrate 551) of the color filter 500. The electrode 556 is formed of a transparent conductive material such as an ITO and entirely covers an area in which pixel electrodes 560 are to be formed which will be described later. An alignment layer 557 is arranged so as to cover a surface of the electrode 556 remote from the pixel electrode 560.

An insulating film 558 is formed on a surface of the counter substrate 551 which faces the color filter 500. On the insulating film 558, scanning lines 561 and signal lines 562 are arranged so as to intersect with each other. Pixel electrodes 560 are formed in areas surrounded by the scanning lines 561 and the signal lines 562. Note that an alignment layer (not shown) is arranged on the pixel electrodes 560 in an actual liquid crystal display device.

Thin-film transistors 563 each of which includes a source electrode, a drain electrode, a semiconductor layer, and a gate electrode are incorporated in areas surrounded by notch portions of the pixel electrodes 560, the scanning lines 561, and the signal lines 562. When signals are supplied to the scanning lines 561 and the signal lines 562, the thin-film transistors 563 are turned on or off so that power supply to the pixel electrodes 560 is controlled.

Note that although each of the display devices 520, 530, and 550 is configured as a transmissive liquid crystal display device, each of the display devices 520, 530, and 550 may be configured as a reflective liquid crystal display device having a reflective layer or a semi-transmissive liquid crystal display device having a semi-transmissive reflective layer.

Figure 16:
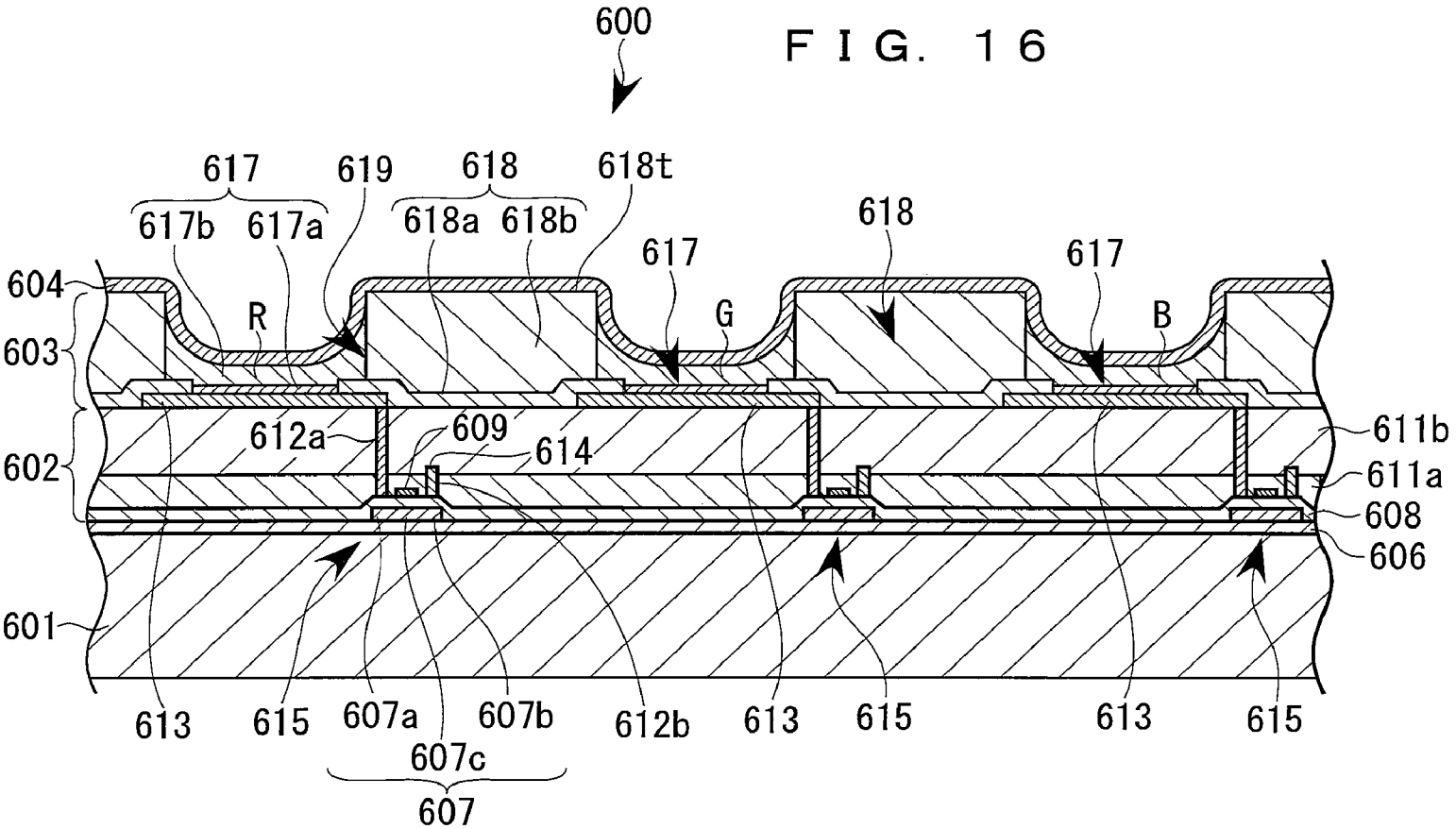
FIG. 16 is a main part sectional view of a display that is an organic EL apparatus.

FIG. 16 is a sectional view illustrating an essential part of a display area of an organic EL device (hereinafter simply referred to as a display device 600).

In this display device 600, a circuit element portion 602, a light-emitting element portion 603, and a cathode 604 are laminated on a substrate (W) 601.

In this display device 600, light is emitted from the light-emitting element portion 603 through the circuit element portion 602 toward the substrate 601 and eventually is emitted to an observer side. In addition, light emitted from the light-emitting element portion 603 toward an opposite side of the substrate 601 is reflected by the cathode 604, and thereafter passes through the circuit element portion 602 and the substrate 601 to be emitted to the observer side.

An underlayer protective film 606 formed of a silicon oxide film is arranged between the circuit element portion 602 and the substrate 601. Semiconductor films 607 formed of polysilicon oxide films are formed on the underlayer protective film 606 (near the light-emitting element portion 603) in an isolated manner. In each of the semiconductor films 607, a source region 607*a* and a drain region 607*b* are formed on the left and right sides thereof, respectively, by high-concentration positive-ion implantation. The center portion of each of the semiconductor films 607 which is not subjected to high-concentration positive-ion implantation serves as a channel region 607*c*.

In the circuit element portion 602, the underlayer protective film 606 and a transparent gate insulating film 608 covering the semiconductor films 607 are formed. Gate electrodes 609 formed of, for example, Al, Mo, Ta, Ti, or W are disposed on the gate insulating film 608 so as to correspond to the channel regions 607*c* of the semiconductor films 607. A first transparent interlayer insulating film 611*a* and a second transparent interlayer insulating film 611*b* are formed on the gate electrodes 609 and the gate insulating film 608. Contact holes 612*a* and 612*b* are formed so as to penetrate the first interlayer insulating film 611*a* and the second interlayer insulating film 611*b* and to be connected to the source region 607*a* and the drain region 607*b* of the semiconductor films 607.

Pixel electrodes 613 which are formed of ITOs, for example, and which are patterned to have a predetermined shape are formed on the second interlayer insulating film 611*b*. The pixel electrode 613 is connected to the source region 607*a* through the contact holes 612*a*.

Power source lines 614 are arranged on the first interlayer insulating film 611*a*. The power source lines 614 are connected through the contact holes 612*b* to the drain region 607*b*.

Thus, the circuit element portion 602 includes thin-film transistors 615 connected to drive the respective pixel electrodes 613.

The light-emitting element portion 603 includes functional layers 617 each formed on a corresponding one of pixel electrodes 613, and bank portions 618 which are formed between the pixel electrodes 613 and the functional layers 617 and which are used to partition the functional layers 617 from one another.

The pixel electrodes 613, the functional layers 617, and the cathode 604 formed on the functional layers 617 constitute the light-emitting element. Note that the pixel electrodes 613 are formed into a substantially rectangular shape in plan view by patterning, and the bank portions 618 are formed so that each two of the pixel electrodes 613 sandwich a corresponding one of the bank portions 618.

Each of the bank portions 618 includes an inorganic bank layer 618*a* (first bank layer) formed of an inorganic material such as SiO, $SiO_2$, or $TiO_2$, and an organic bank layer 618*b* (second bank layer) which is formed on the inorganic bank layer 618*a* and has a trapezoidal shape in a sectional view. The organic bank layer 618*b* is formed of a resist, such as an acrylic resin or a polyimide resin, which has an excellent heat resistance and an excellent lyophobic characteristic. A part of each of the bank portions 618 overlaps peripheries of corresponding two of the pixel electrodes 613 which sandwich each of the bank portions 618.

Openings 619 are formed between the bank portions 618 so as to gradually increase in size upwardly against the pixel electrodes 613.

Each of the functional layers 617 includes a positive-hole injection/transport layer 617*a* formed so as to be laminated on the pixel electrodes 613 and a light-emitting layer 617*b* formed on the positive-hole injection/transport layer 617*a*. Note that another functional layer having another function may be arranged so as to be arranged adjacent to the light-emitting layer 617*b*. For example, an electronic transport layer may be formed.

The positive-hole injection/transport layer 617*a* transports positive holes from a corresponding one of the pixel electrodes 613 and injects the transported positive holes to the light-emitting layer 617*b*. The positive-hole injection/transport layer 617*a* is formed by ejection of a first composition (functional liquid) including a positive-hole injection/transport layer forming material. The positive-hole injection/transport layer forming material may be a known material.

The light-emitting layer 617*b* is used for emission of light having colors red (R), green (G), or blue (B), and is formed by ejection of a second composition (functional liquid) including a material for forming the light-emitting layer 617*b* (light-emitting material). As a solvent of the second composition (nonpolar solvent), a known material which is insoluble to the positive-hole injection/transport layer 617*a* is preferably used. Since such a nonpolar solvent is used as the second composition of the light-emitting layer 617*b*, the light-emitting layer 617*b* can be formed without dissolving the positive-hole injection/transport layer 617*a* again.

The light-emitting layer 617*b* is configured such that the positive holes injected from the positive-hole injection/transport layer 617*a* and electrons injected from the cathode 604 are recombined in the light-emitting layer 617*b* so as to emit light.

The cathode 604 is formed so as to cover an entire surface of the light-emitting element portion 603, and in combination with the pixel electrodes 613, supplies current to the functional layers 617. Note that a sealing member (not shown) is arranged on the cathode 604.

Steps of manufacturing the display device 600 will now be described with reference to FIGS. 17 to 25.

Figure 17:
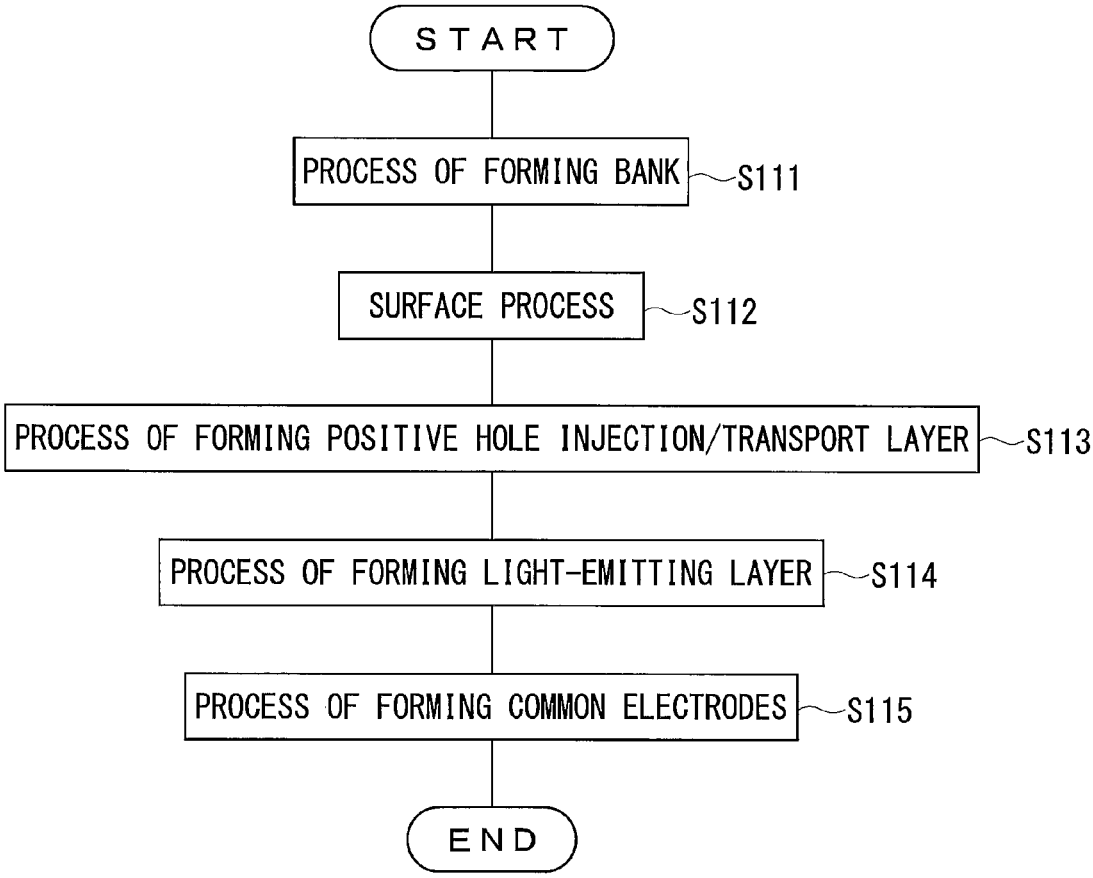
FIG. 17 is a flow chart illustrating processes of manufacturing the display that is an organic EL apparatus.

As shown in FIG. 17, the display device 600 is manufactured through a bank portion forming step (S111), a surface processing step (S112), a positive-hole injection/transport layer forming step (S113), a light-emitting layer forming step (S114), and a counter electrode forming step (S115). Note that the manufacturing steps are not limited to these examples shown in FIG. 17, and one of these steps may be omitted or another step may be added according as desired.

Figure 18:
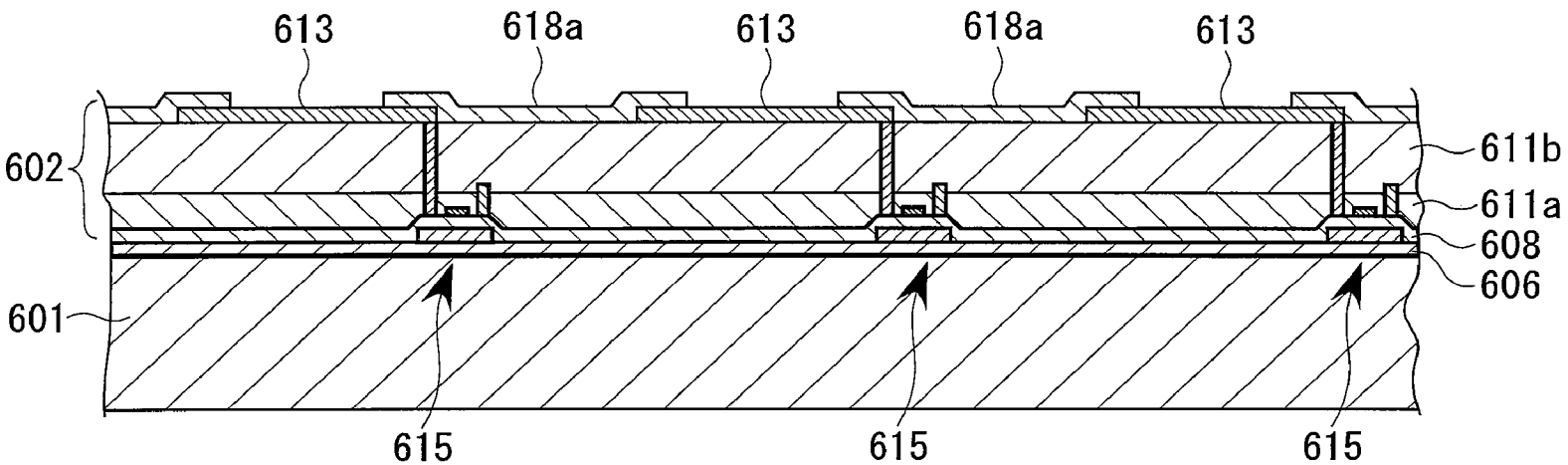
FIG. 18 is a process diagram illustrating formation of an inorganic bank layer.

In the bank portion forming step (S111), as shown in FIG. 18, the inorganic bank layers 618*a* are formed on the second interlayer insulating film 611*b*. The inorganic bank layers 618*a* are formed by forming an inorganic film at a desired position and by patterning the inorganic film by the photolithography technique. At this time, a part of each of the inorganic bank layers 618*a* overlaps peripheries of corresponding two of the pixel electrodes 613 which sandwich each of the inorganic bank layers 618*a*.

Figure 19:
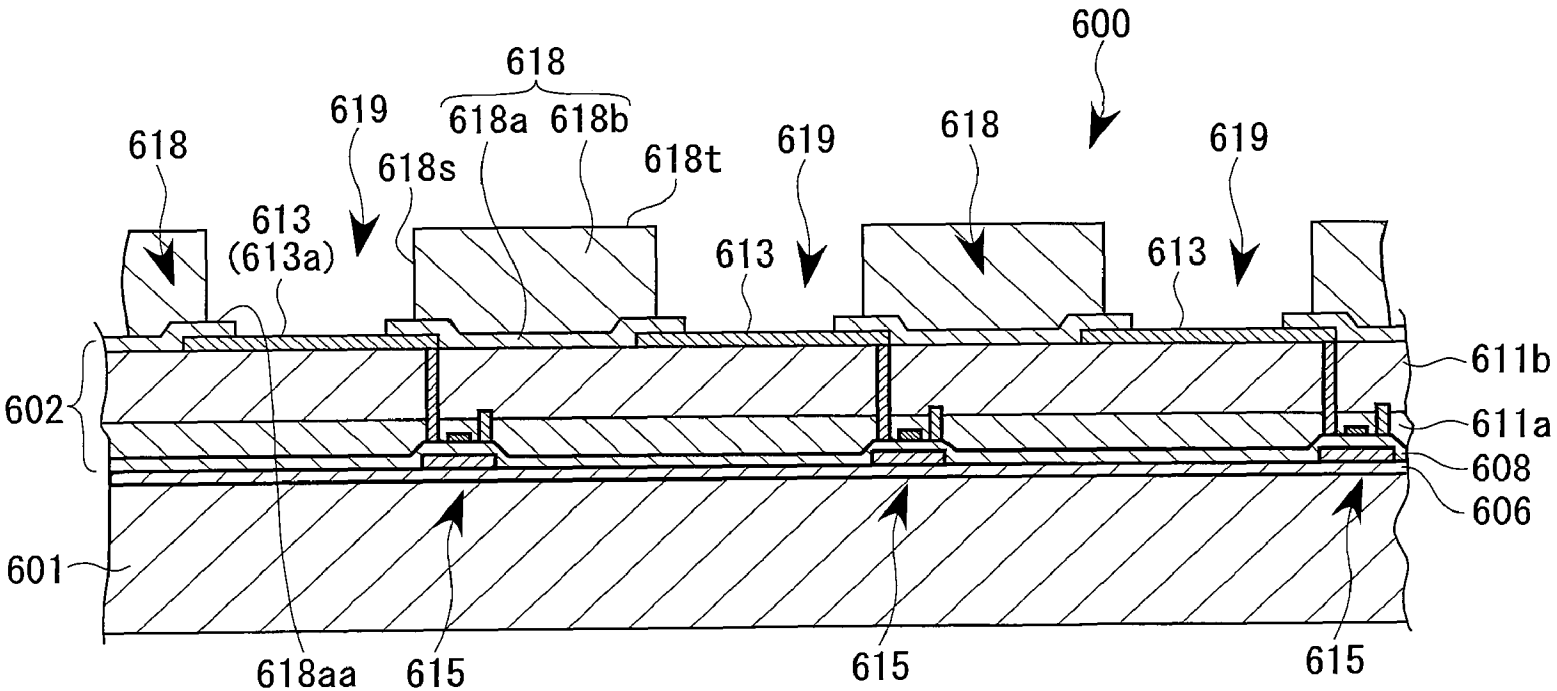
FIG. 19 is a process diagram illustrating formation of an organic bank layer.

After the inorganic bank layers 618*a* are formed, as shown in FIG. 19, the organic bank layers 618*b* are formed on the inorganic bank layers 618*a*. As with the inorganic bank layers 618*a*, the organic bank layers 618*b* are formed by patterning a formed organic film by the photolithography technique.

The bank portions 618 are thus formed. When the bank portions 618 are formed, the openings 619 opening upward relative to the pixel electrodes 613 are formed between the bank portions 618. The openings 619 define pixel areas.

In the surface processing step (S112), a hydrophilic treatment and a repellency treatment are performed. The hydrophilic treatment is performed on first lamination areas 618*aa* of the inorganic bank layers 618*a* and electrode surfaces 613*a* of the pixel electrodes 613. The hydrophilic treatment is performed, for example, by plasma processing using oxide as a processing gas on surfaces of the first lamination areas 618*aa* and the electrode surfaces 613*a* to have hydrophilic properties. By performing the plasma processing, the ITO forming the pixel electrodes 613 is cleaned.

The repellency treatment is performed on walls 618*s* of the organic bank layers 618*b* and upper surfaces 618*t* of the organic bank layers 618*b*. The repellency treatment is performed as a fluorination treatment, for example, by plasma processing using tetrafluoromethane as a processing gas on the walls 618*s* and the upper surfaces 618*t*.

By performing this surface processing step, when the functional layers 617 is formed using the functional liquid droplet ejection heads 17, the functional liquid droplets are ejected onto the pixel areas with high accuracy. Furthermore, the functional liquid droplets attached onto the pixel areas are prevented from flowing out of the openings 619.

A display device body 600A is obtained through these steps. The display device body 600A is mounted on the set table 21 of the liquid droplet ejection apparatus 1 shown in FIG. 1 and the positive-hole injection/transport layer forming step (S113) and the light-emitting layer forming step (S114) are performed thereon.

Figure 20:
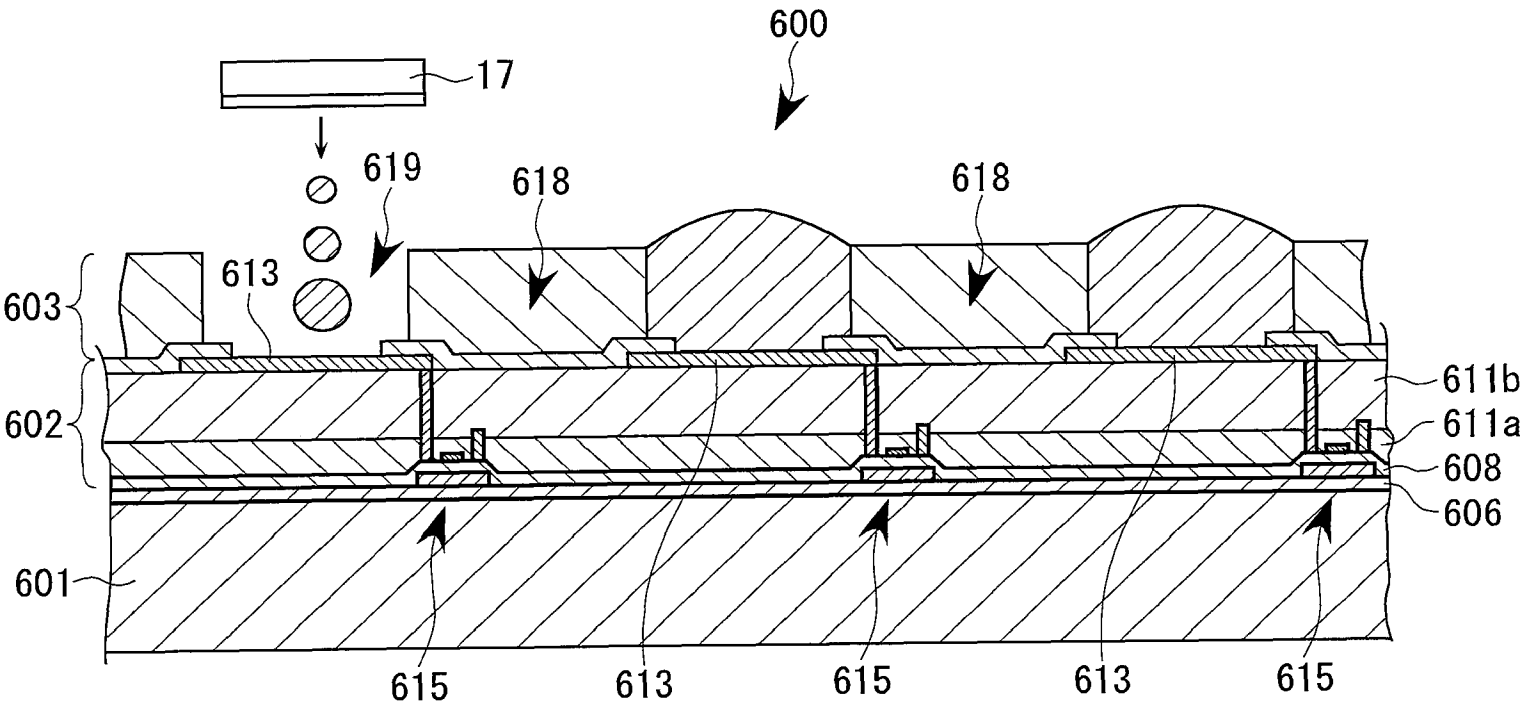
FIG. 20 is a process diagram illustrating a process of forming a positive hole injection/transport layer.
Figure 21:
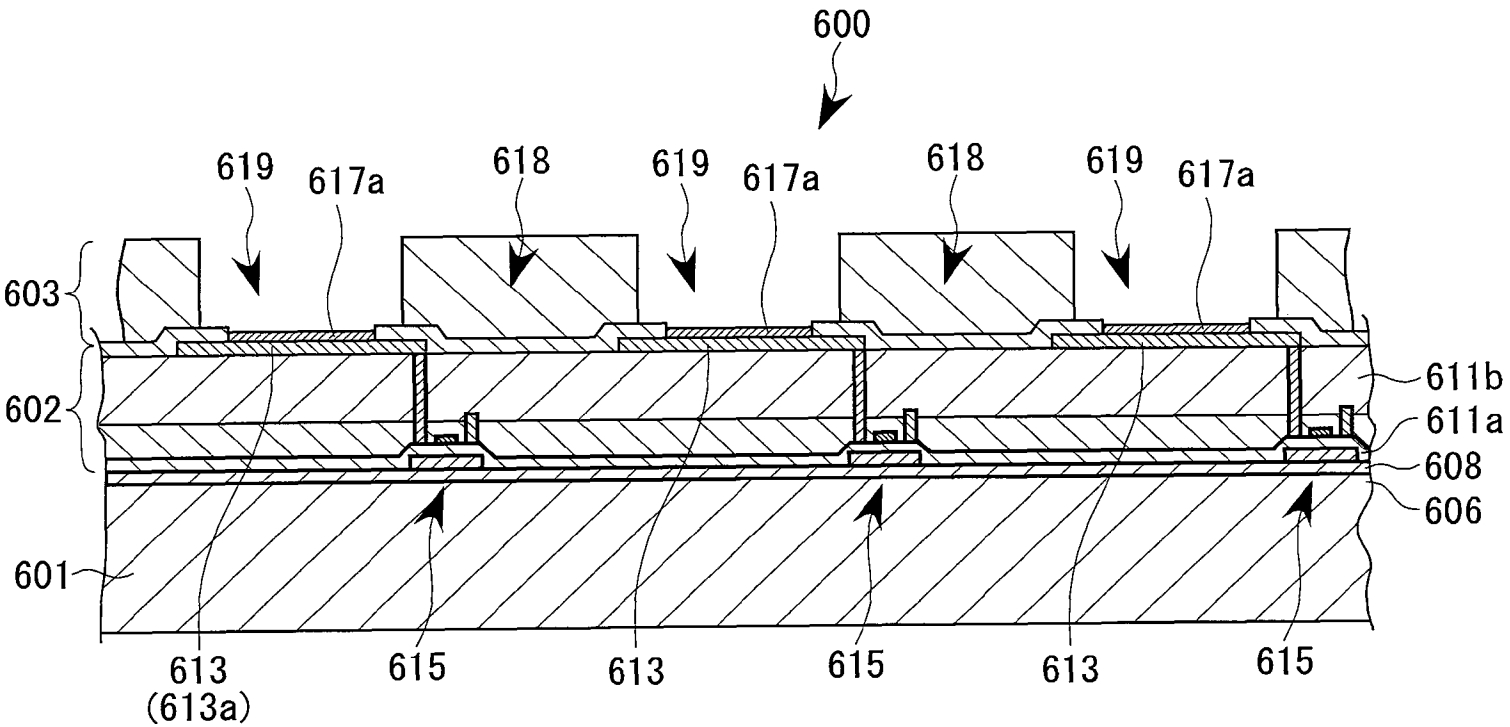
FIG. 21 is a process diagram illustrating a state in which the positive hole injection/transport layer has been formed.

As shown in FIG. 20, in the positive-hole injection/transport layer forming step (S113), the first compositions including the material for forming a positive-hole injection/transport layer are ejected from the functional liquid droplet ejection heads 17 into the openings 619 included in the pixel areas. Thereafter, as shown in FIG. 21, drying processing and a thermal treatment are performed to evaporate polar solution included in the first composition whereby the positive-hole injection/transport layers 617*a* are formed on the pixel electrodes 613 (electrode surface 613*a*).

The light-emitting layer forming step (S114) will now be described. In the light-emitting layer forming step, as described above, a nonpolar solvent which is insoluble to the positive-hole injection/transport layers 617*a* is used as the solvent of the second composition used at the time of forming the light-emitting layer in order to prevent the positive-hole injection/transport layers 617*a* from being dissolved again.

On the other hand, since each of the positive-hole injection/transport layers 617*a* has low affinity to a nonpolar solvent, even when the second composition including the nonpolar solvent is ejected onto the positive-hole injection/transport layers 617*a*, the positive-hole injection/transport layers 617*a* may not be brought into tight contact with the light-emitting layers 617*b* or the light-emitting layers 617*b* may not be uniformly applied.

Accordingly, before the light-emitting layers 617*b* are formed, surface processing (surface improvement processing) is preferably performed so that each of the positive-hole injection/transport layers 617*a* has high affinity to the nonpolar solvent and to the material for forming the light-emitting layers. The surface processing is performed by applying a solvent the same as or similar to the nonpolar solvent of the second composition used at the time of forming the light-emitting layers on the positive-hole injection/transport layers 617*a* and by drying the applied solvent.

Employment of this surface processing allows the surface of the positive-hole injection/transport layers 617*a* to have high affinity to the nonpolar solvent, and therefore, the second composition including the material for forming the light-emitting layers can be uniformly applied to the positive-hole injection/transport layers 617*a* in the subsequent step.

Figure 22:
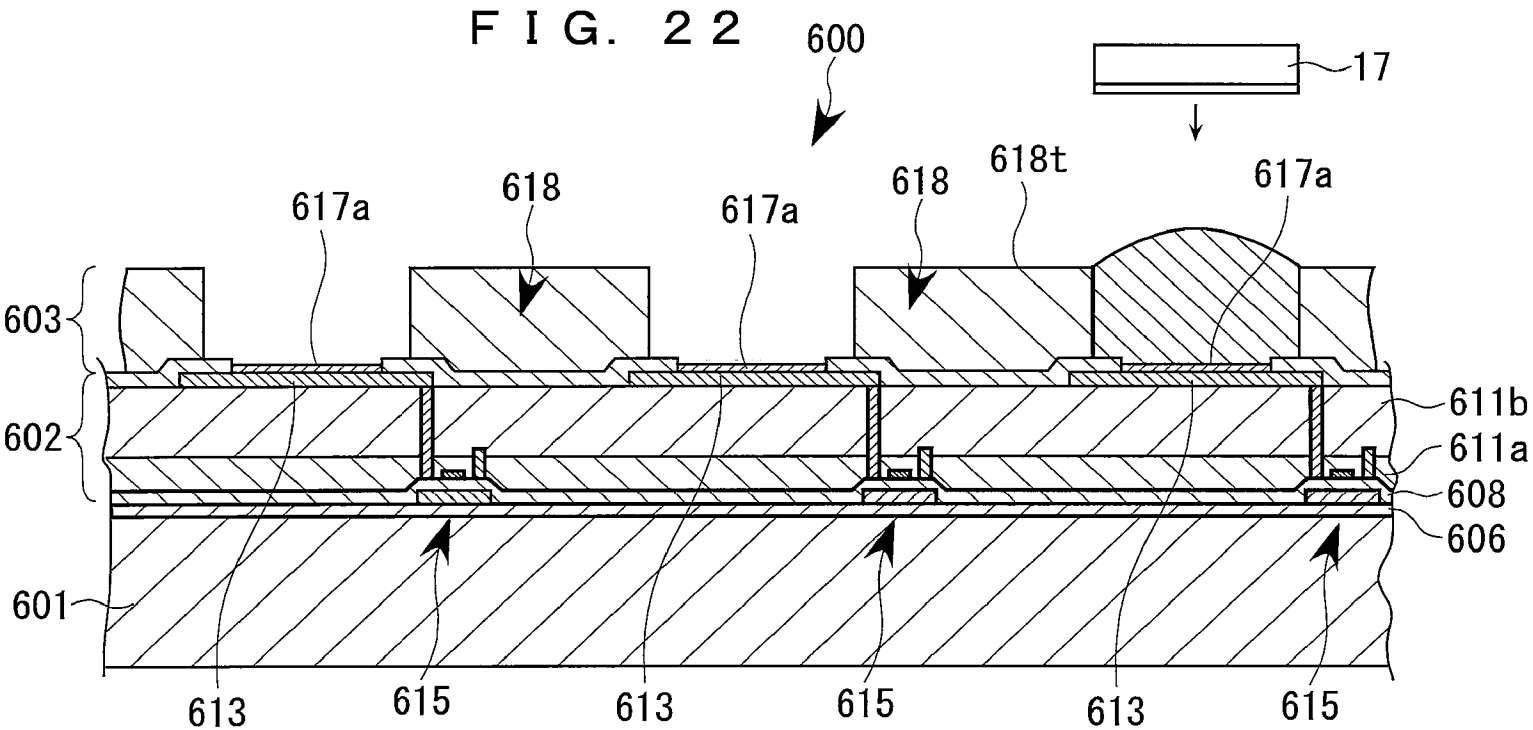
FIG. 22 is a process diagram illustrating a process of forming a blue luminous layer.

As shown in FIG. 22, a predetermined amount of second composition including the material for forming the light-emission layers of one of the three colors (blue color (B) in an example of FIG. 22) is ejected into the pixel areas (openings 619) as functional liquid. The second composition ejected into the pixel areas spreads over the positive-hole injection/transport layer 617*a* and fills the openings 619. Note that, even if the second composition is ejected and attached to the upper surfaces 618*t* of the bank portions 618 which are outside of the pixel area, since the repellency treatment has been performed on the upper surfaces 618*t* as described above, the second component easily drops into the openings 619.

Figure 23:
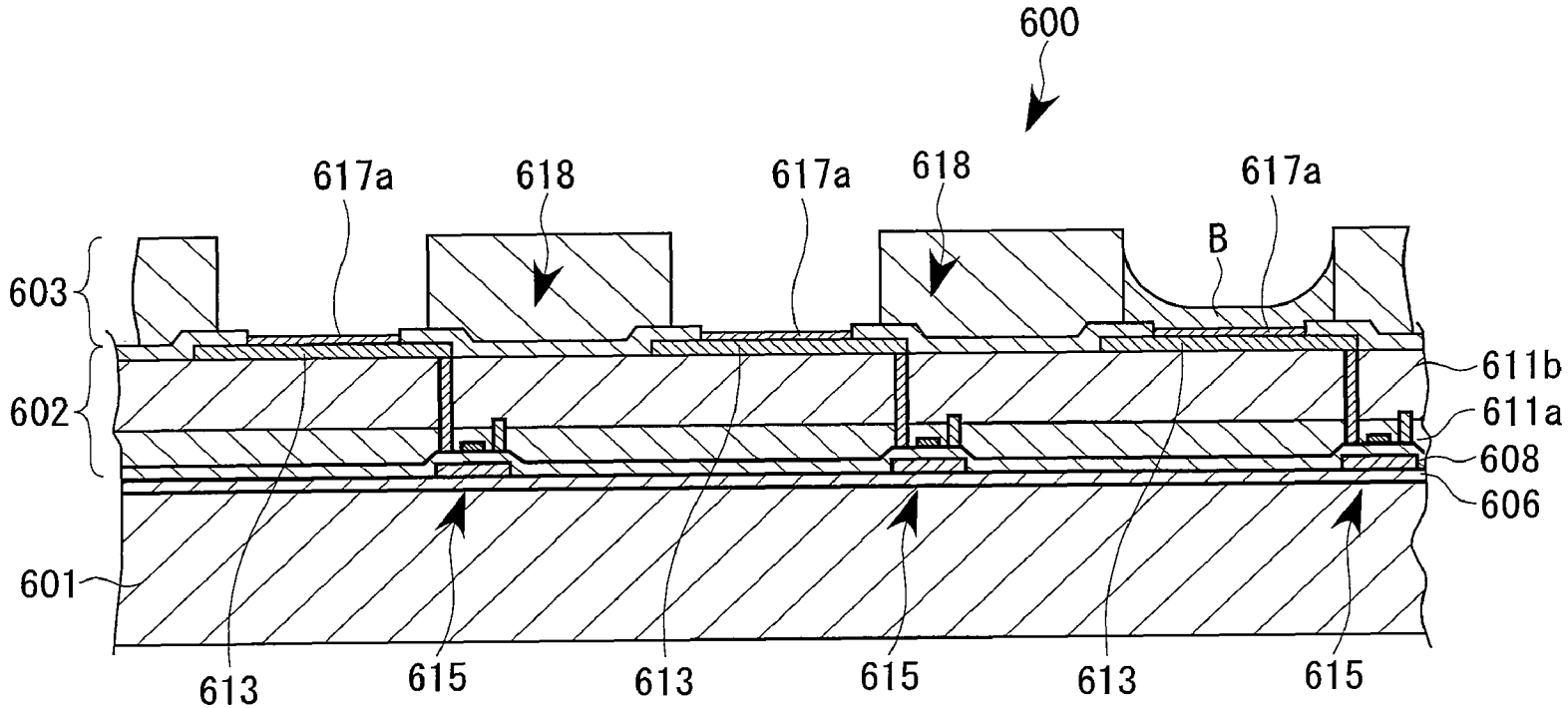
FIG. 23 is a process diagram illustrating a state in which the blue luminous layer has been formed.

Thereafter, the drying processing is performed so that the ejected second composition is dried and the nonpolar solvent included in the second composition is evaporated whereby the light-emitting layers 617*b* are formed on the positive-hole injection/transport layers 617*a* as shown in FIG. 23. In FIG. 23, one of the light-emitting layers 617*b* corresponding to the blue color (B) is formed.

Figure 24:
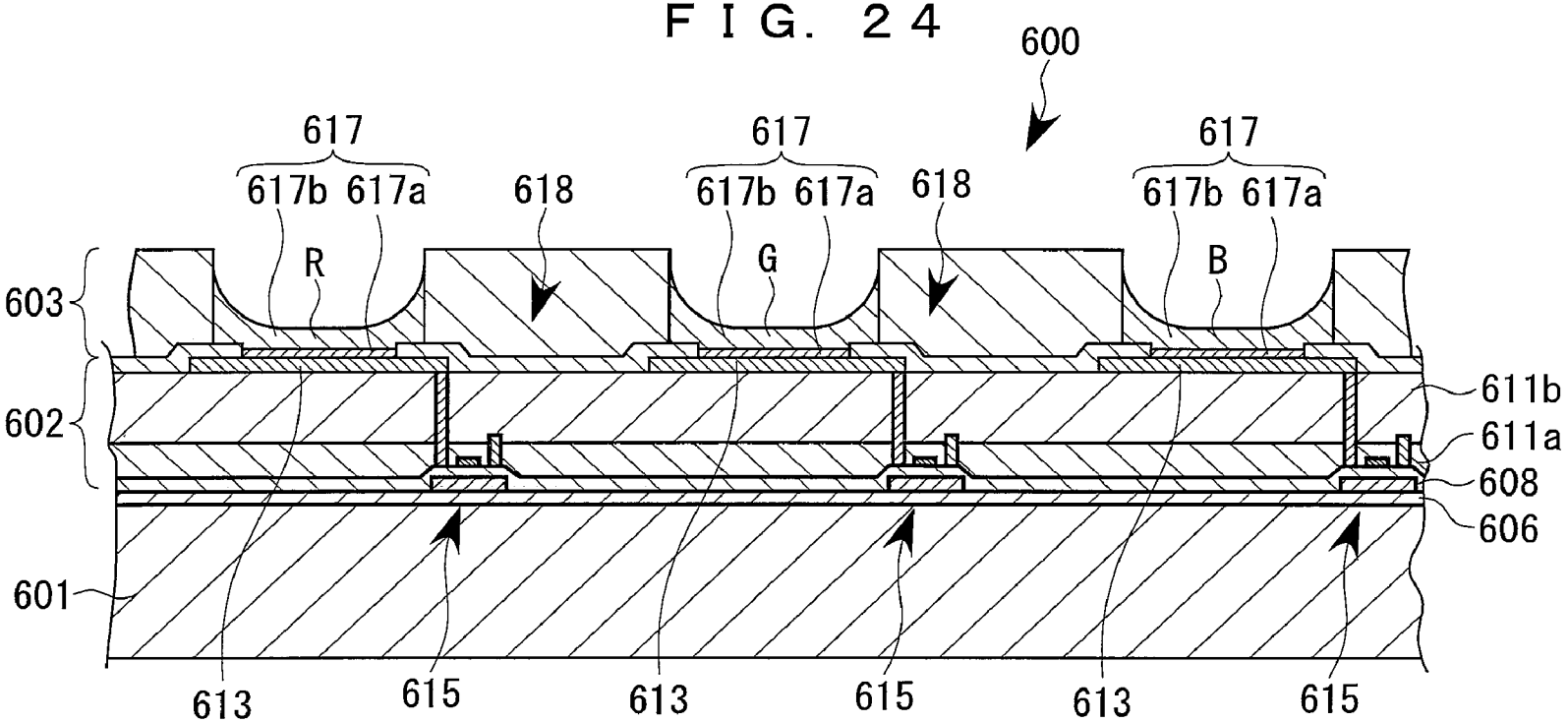
FIG. 24 is a process diagram illustrating a state in which luminous layers in all colors have been formed.

Similarly, as shown in FIG. 24, a step similar to the above-described step of forming the light-emitting layers 617*b* corresponding to the blue color (B) is repeatedly performed by using functional liquid droplet ejection heads 17 so that the light-emitting layers 617*b* corresponding to other colors (red (R) and green (G)) are formed. Note that the order of formation of the light-emitting layers 617*b* is not limited to the order described above as an example, and any other orders may be applicable. For example, an order of forming the light-emitting layers 617*b* may be determined in accordance with a light-emitting layer forming material. Furthermore, the color scheme pattern of the three colors R, G, and B may be the stripe arrangement, the mosaic arrangement, or the delta arrangement.

As described above, the functional layers 617, that is, the positive-hole injection/transport layers 617*a* and the light-emitting layers 617*b* are formed on the pixel electrodes 613. Then, the process proceeds to the counter electrode forming step (S115).

Figure 25:
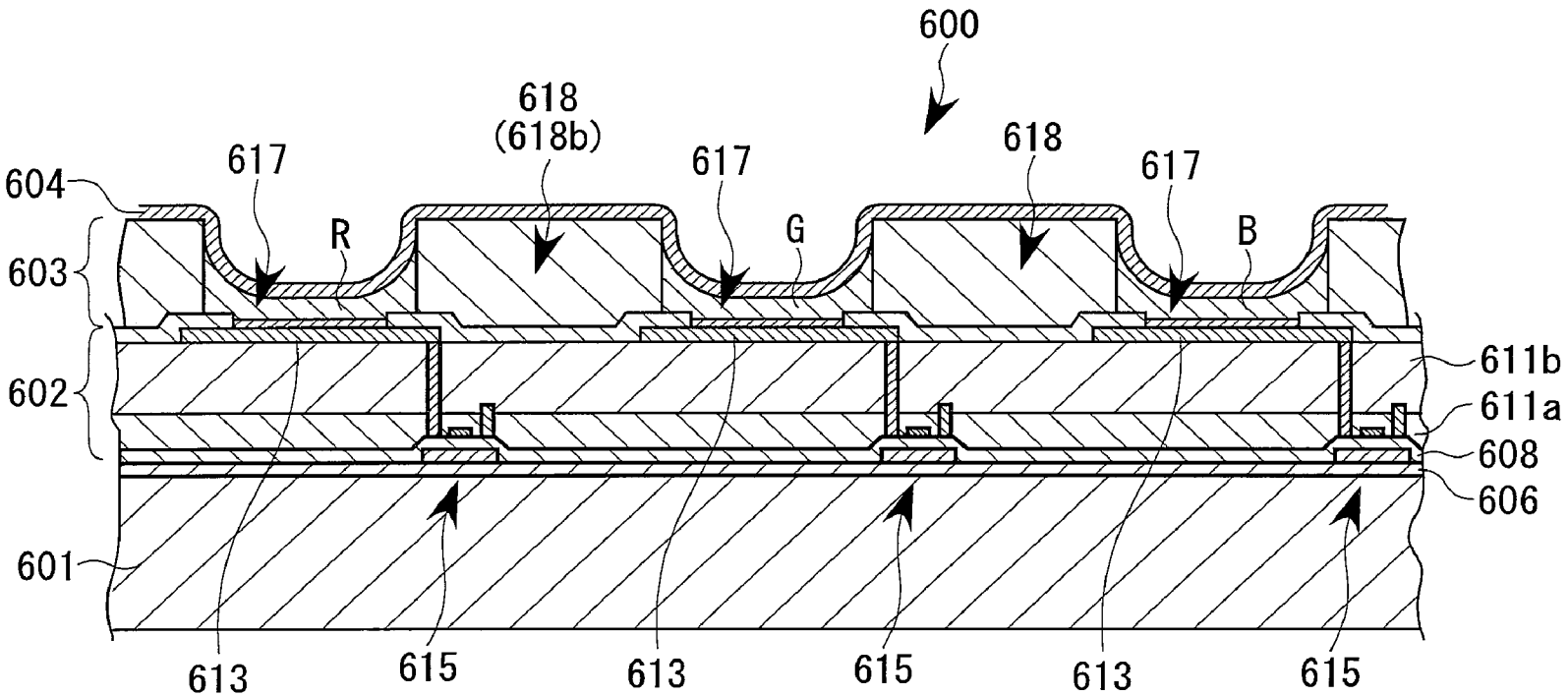
FIG. 25 is a process diagram illustrating formation of a negative electrode.

In the counter electrode forming step (S115), as shown in FIG. 25, the cathode (counter electrode) 604 is formed on entire surfaces of the light-emitting layers 617*b* and the organic bank layers 618*b* by an evaporation method, sputtering, or a CVD (chemical vapor deposition) method, for example. The cathode 604 is formed by laminating a calcium layer and an aluminum layer, for example, in this embodiment.

An Al film and a Ag film as electrodes and a protective layer formed of $SiO_2$ or SiN for preventing the Al film and the Ag film from being oxidized are formed on the cathode 604.

After the cathode 604 is thus formed, other processes such as sealing processing of sealing a top surface of the cathode 604 with a sealing member and wiring processing are performed whereby the display device 600 is obtained.

Figure 26:
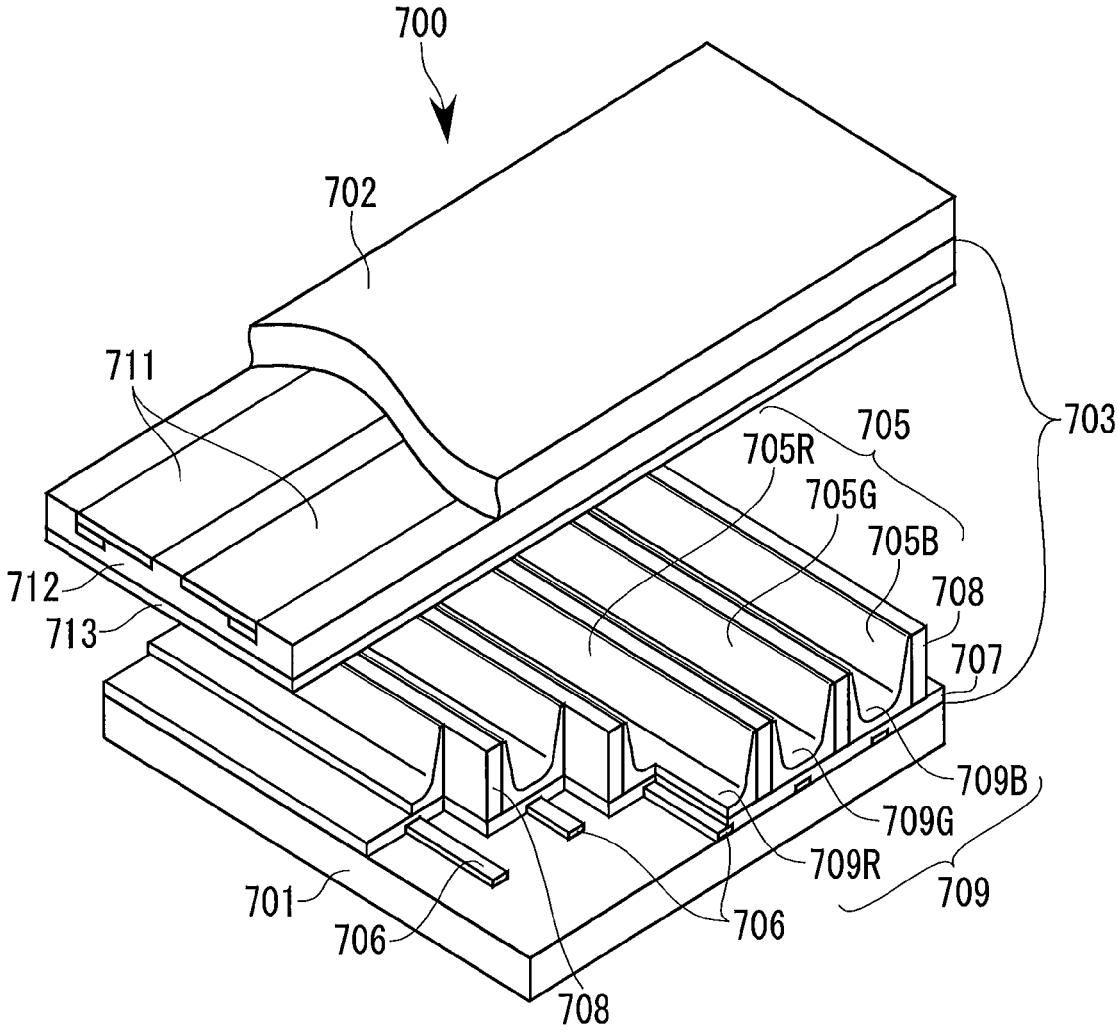
FIG. 26 is an exploded perspective view of a main part of a display that is a plasma display panel apparatus (PDP apparatus).

FIG. 26 is an exploded perspective view of an essential part of a plasma display device (PDP device: hereinafter simply referred to as a display device 700). Note that, in FIG. 26, the display device 700 is partly cut away.

The display device 700 includes a first substrate 701, a second substrate 702 which faces the first substrate 701, and a discharge display portion 703 interposed therebetween. The discharge display portion 703 includes a plurality of discharge chambers 705. The discharge chambers 705 include red discharge chambers 705R, green discharge chambers 705G, and blue discharge chambers 705B, and are arranged so that one of the red discharge chambers 705R, one of the green discharge chambers 705G, and one of the blue discharge chambers 705B constitute one pixel as a group.

Address electrodes 706 are arranged on the first substrate 701 with predetermined intervals therebetween in a stripe pattern, and a dielectric layer 707 is formed so as to cover top surfaces of the address electrodes 706 and the first substrate 701. Partition walls 708 are arranged on the dielectric layer 707 so as to be arranged along with the address electrodes 706 in a standing manner between the adjacent address electrodes 706. Some of the partition walls 708 extend in a width direction of the address electrodes 706 as shown in FIG. 26, and the others (not shown) extend perpendicular to the address electrodes 706.

Regions partitioned by the partition walls 708 serve as the discharge chambers 705.

The discharge chambers 705 include respective fluorescent substances 709. Each of the fluorescent substances 709 emits light having one of the colors of red (R), green (G) and blue (B). The red discharge chamber 705R has a red fluorescent substance 709R on its bottom surface, the green discharge chamber 705G has a green fluorescent substance 709G on its bottom surface, and the blue discharge chamber 705B has a blue fluorescent substance 709B on its bottom surface.

On a lower surface of the second substrate 702 in FIG. 26, a plurality of display electrodes 711 are formed with predetermined intervals therebetween in a stripe manner in a direction perpendicular to the address electrodes 706. A dielectric layer 712 and a protective film 713 formed of MgO, for example, are formed so as to cover the display electrodes 711.

The first substrate 701 and the second substrate 702 are attached so that the address electrodes 706 are arranged perpendicular to the display electrodes 711. Note that the address electrodes 706 and the display electrodes 711 are connected to an alternate power source (not shown).

When the address electrodes 706 and the display electrodes 711 are brought into conduction states, the fluorescent substances 709 are excited and emit light whereby display with colors is achieved.

In this embodiment, the address electrodes 706, the display electrodes 711, and the fluorescent substances 709 may be formed using the liquid droplet ejection apparatus 1 shown in FIG. 1. Steps of forming the address electrodes 706 on the first substrate 701 are described hereinafter.

The steps are performed in a state where the first substrate 701 is mounted on the set table 21 on the liquid droplet ejection apparatus 1.

The functional liquid droplet ejection heads 17 eject a liquid material (functional liquid) including a material for forming a conducting film wiring as functional droplets to be attached onto regions for forming the address electrodes 706. The material for forming a conducting film wiring included in the liquid material is formed by dispersing conductive fine particles such as those of a metal into dispersed media. Examples of the conductive fine particles include a metal fine particle including gold, silver, copper, palladium, or nickel, and a conductive polymer.

When ejection of the liquid material onto all the desired regions for forming the address electrodes 706 is completed, the ejected liquid material is dried, and the disperse media included in the liquid material is evaporated whereby the address electrodes 706 are formed.

Although the steps of forming the address electrodes 706 are described as an example above, the display electrodes 711 and the fluorescent substances 709 may be formed by the steps described above.

In a case where the display electrodes 711 are formed, as with the address electrodes 706, a liquid material (functional liquid) including a material for forming a conducting film wiring is ejected from the functional liquid droplet ejection heads 17 as liquid droplets to be attached to the areas for forming the display electrodes.

In a case where the fluorescent substances 709 are formed, a liquid material including fluorescent materials corresponding to three colors (R, G, and B) is ejected as liquid droplets from the functional liquid droplet ejection heads 17 so that liquid droplets having the three colors (R, G, and B) are attached within the discharge chambers 705.

Figure 27:
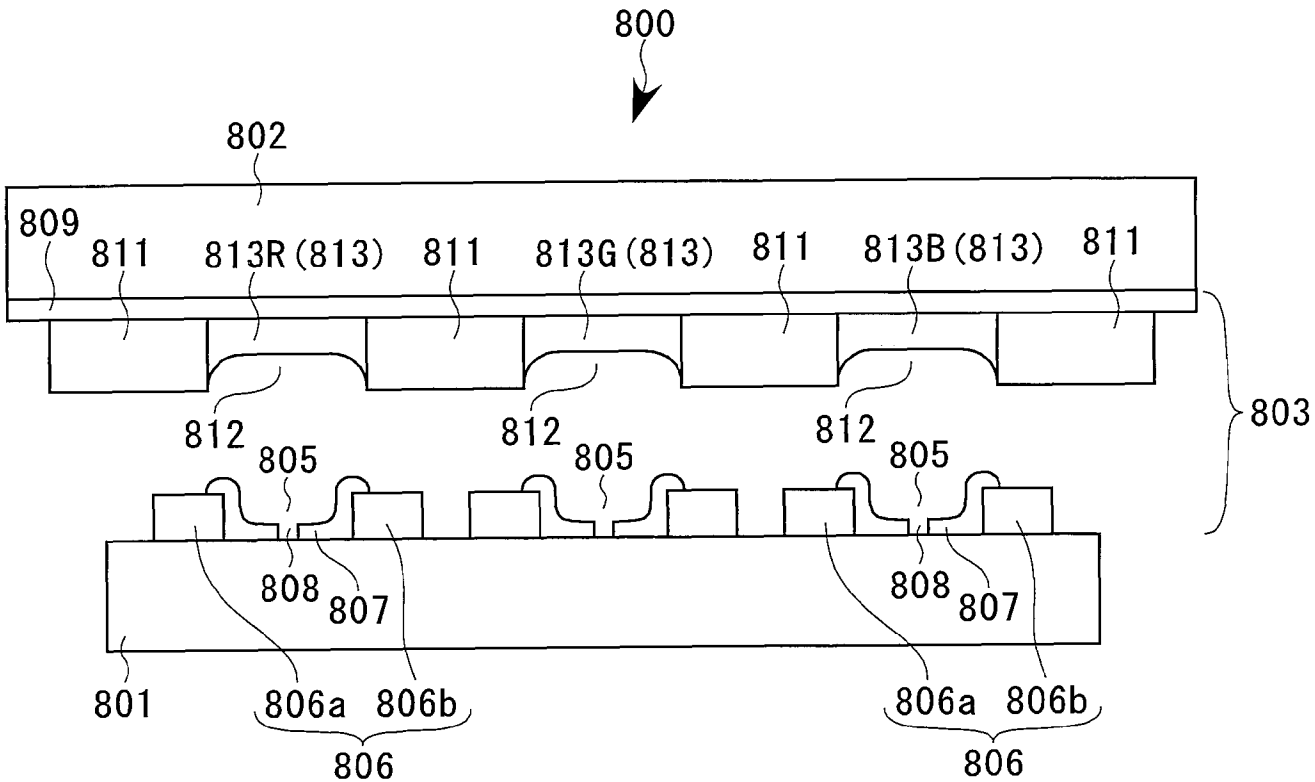
FIG. 27 is a sectional view of a main part of a display that is a field emission display apparatus (FED apparatus).

FIG. 27 shows a sectional view of an essential part of an electron emission device (also referred to as a FED device or a SED device: hereinafter simply referred to as a display device 800). In FIG. 27, a part of the display device 800 is shown in the sectional view.

The display device 800 includes a first substrate 801, a second substrate 802 which faces the first substrate 801, and a field-emission display portion 803 interposed therebetween. The field-emission display portion 803 includes a plurality of electron emission portions 805 arranged in a matrix.

First element electrodes 806*a* and second element electrodes 806*b*, and conductive films 807 are arranged on the first substrate 801. The first element electrodes 806*a* and the second element electrodes 806*b* intersect with each other. Cathode electrodes 806 are formed on the first substrate 801, and each of the cathode electrodes 806 is constituted by one of the first element electrodes 806*a* and one of the second element electrodes 806*b*. In each of the cathode electrodes 806, one of the conductive films 807 having a gap 808 is formed in a portion formed by the first element electrode 806*a* and the second element electrode 806*b*. That is, the first element electrodes 806*a*, the second element electrodes 806*b*, and the conductive films 807 constitute the plurality of electron emission portions 805. Each of the conductive films 807 is constituted by palladium oxide (PdO). In each of the cathode electrodes 806, the gap 808 is formed by forming processing after the corresponding one of the conductive films 807 is formed.

An anode electrode 809 is formed on a lower surface of the second substrate 802 so as to face the cathode electrodes 806. A bank portion 811 is formed on a lower surface of the anode electrode 809 in a lattice. Fluorescent materials 813 are arranged in opening portions 812 which opens downward and which are surrounded by the bank portion 811. The fluorescent materials 813 correspond to the electron emission portions 805. Each of the fluorescent materials 813 emits fluorescent light having one of the three colors, red (R), green (G), and blue (B). Red fluorescent materials 813R, green fluorescent materials 813G, and blue fluorescent materials 813B are arranged in the opening portions 812 in a predetermined arrangement pattern described above.

The first substrate 801 and the second substrate 802 thus configured are attached with each other with a small gap therebetween. In this display device 800, electrons emitted from the first element electrodes 806*a* or the second element electrodes 806*b* included in the cathode electrodes 806 hit the fluorescent materials 813 formed on the anode electrode 809 so that the fluorescent materials 813 are excited and emit light whereby display with colors is achieved.

As with the other embodiments, in this case also, the first element electrodes 806*a*, the second element electrodes 806*b*, the conductive films 807, and the anode electrode 809 may be formed using the liquid droplet ejection apparatus 1. In addition, the red fluorescent materials 813R, the green fluorescent materials 813G, and the blue fluorescent materials 813B may be formed using the liquid droplet ejection apparatus 1.

Figure 28A:
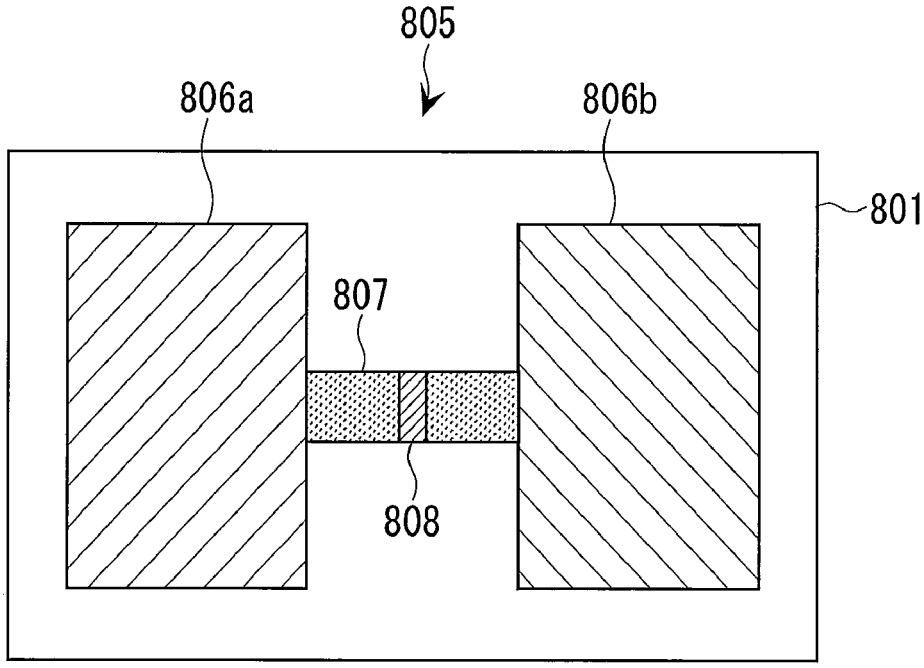
FIG. 28A is a plane view of an electron emitter included in the display and its surroundings.
Figure 28B:
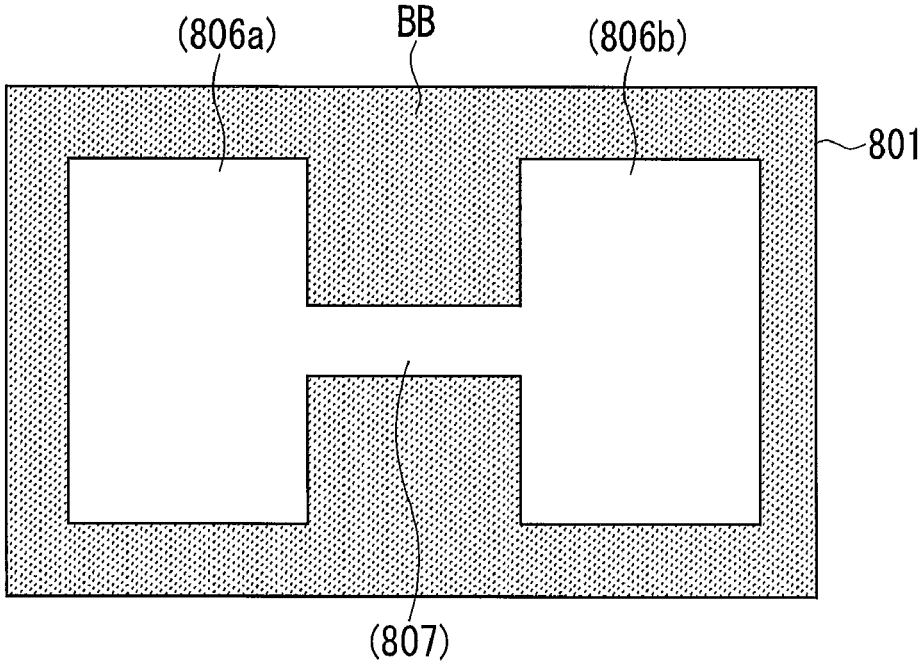
FIG. 28B is a plane view showing a method of its formation.

Each of the first element electrodes 806*a*, each of the second element electrodes 806*b*, and each of the conductive films 807 have shapes as shown in FIG. 28A. When the first element electrodes 806*a*, the second element electrodes 806*b*, and the conductive films 807 are formed, portions for forming the first element electrodes 806*a*, the second element electrodes 806*b*, and the conductive films 807 are left as they are on the first substrate 801 and only bank portions BB are formed (by a photolithography method) as shown in FIG. 28B. Then, the first element electrodes 806*a* and the second element electrodes 806*b* are formed by an inkjet method using a solvent ejected from the liquid droplet ejection apparatus 1 in grooves defined by the bank portions BB and are formed by drying the solvent. Thereafter, the conductive films 807 are formed by the inkjet method using the liquid droplet ejection apparatus 1. After forming the conductive films 807, the bank portions BB are removed by ashing processing and the forming processing is performed. Note that, as with the case of the organic EL device, the hydrophilic treatment is preferably performed on the first substrate 801 and the second substrate 802 and the repellency treatment is preferably performed on the bank portion 811 and the bank portions BB.

Examples of other electro-optical devices include a device for forming metal wiring, a device for forming a lens, a device for forming a resist, and a device for forming an optical diffusion body. Use of the liquid droplet ejection apparatus 1 makes it possible to efficiently manufacture various electro-optical devices.

What is claimed is:

1. A head unit arrangement method for arranging a plurality of head units in alignment in a Y-axis direction in a liquid droplet ejection device that plots an image in a matrix form with functional liquid droplets in a number n of colors by performing the number n of primary scans for plotting by moving the plurality of head units relatively to a workpiece in an X-axis direction and a number (n−1) of secondary scans for moving the plurality of head units by a space equivalent to a divisional plotted line relatively in the Y-axis direction, with the plurality of head units being arranged in alignment in the Y-axis direction, each having a carriage equipped with functional liquid droplet ejection heads respectively for the number n of colors for forming a plurality of divisional plotted lines for each of the colors in the Y-axis direction with each nozzle row while staggered in the Y-axis direction on the carriage, the head unit arrangement method comprising:

evaluating liquid droplet ejection performance of each of the head units based on an inspection result of a volume of liquid droplet ejection from each of the functional liquid droplet ejection heads to arrange two of the head units that exhibit the lowest liquid droplet ejection performance at both ends in the Y-axis direction.

2. The head unit arrangement method according to claim 1, wherein in evaluating the liquid droplet ejection performance of each of the head units, the respective functional liquid droplet ejection heads are given ranks based on whether the heads meet a variation range condition under which variations in the liquid droplet ejection volume obtained through an inspection on respective ejection nozzles in the nozzle row are within a predetermined variation range and an intercept range condition under which a difference between an average in the liquid droplet ejection volume obtained through the inspection on the respective ejection nozzles and the liquid droplet ejection volume of each of two nozzles located at the respective ends of the nozzle row is within a predetermined permissible range, and the head units are evaluated based on the ranks given to the respective functional liquid droplet heads.

3. The head unit arrangement method according to claim 2, wherein in evaluating the liquid droplet ejection performance of each of the head units, the liquid droplet ejection performance of the head units is evaluated by the lowest rank of the ranks given to the respective functional liquid droplet ejection heads mounted.

4. The head unit arrangement method according to claim 1, wherein evenness in the liquid droplet ejection volume between the respective head units is evaluated based on the difference in the liquid droplet ejection volume between the nearest of the ejection nozzles for each of the colors located respectively on the plurality of head units except for the two head units located on both the ends, so that the head units are arranged in a combination that exhibits the greatest evenness in the liquid droplet ejection volume.

5. The head unit arrangement method according to claim 4, wherein in evaluating the evenness in the liquid droplet ejection volume between the respective head units, the evenness in the liquid droplet ejection volume is evaluated based on the maximum of the differences in the liquid droplet ejection volume for all the colors at all boundaries between the respective head units.

6. The head unit arrangement method according to claim 4, wherein the liquid droplet ejection volume of each of the two ejection nozzles to be used to calculate the difference in the liquid droplet ejection volume is an average in the liquid droplet ejection volume between two or more ejection nozzles located on respective corresponding ends.

7. The head unit arrangement method according to claim 1, wherein the plurality of head units are selected from numerous candidate head units, and the plurality of head units that exhibit the highest liquid droplet ejection performance from the numerous candidate head units are selected in selecting the plurality of head units.

* * * * *